US006997667B2

(12) United States Patent
Hackett et al.

(10) Patent No.: US 6,997,667 B2
(45) Date of Patent: Feb. 14, 2006

(54) MATERIAL HANDLING APPARATUS AND METHOD FOR OPERATING

(75) Inventors: Jeffrey K. Hackett, Benidict, MN (US); Garry W. Rudd, Nevis, MN (US)

(73) Assignee: Skid Mor Development LLC, Nevis, MN (US)

( * ) Notice: Subject to any disclaimer, the term of this patent is extended or adjusted under 35 U.S.C. 154(b) by 0 days.

(21) Appl. No.: 10/294,464

(22) Filed: Nov. 13, 2002

(65) Prior Publication Data

US 2004/0091347 A1 May 13, 2004

(51) Int. Cl.
*E02F 9/00* (2006.01)

(52) U.S. Cl. ..... 414/685; 414/501

(58) Field of Classification Search ..... 414/680, 414/685, 686, 486, 487, 491, 501, 694; 254/134.3; 405/180; 296/146.1, 146.8, 146.9; 298/22 P, 298/22 R, 29
See application file for complete search history.

(56) References Cited

U.S. PATENT DOCUMENTS

| | | | | |
|---|---|---|---|---|
| 631,096 A | | 8/1899 | Smith | |
| 2,052,471 A | * | 8/1936 | Hula | 296/146.8 |
| 2,424,670 A | | 7/1947 | Shimer | |
| 2,427,132 A | | 9/1947 | Godbey | |

(Continued)

FOREIGN PATENT DOCUMENTS

| | | |
|---|---|---|
| GB | 2 258 210 A | 2/1993 |
| KR | 20-0167202 | 4/1999 |
| KR | 20-0200480 | 10/2000 |

OTHER PUBLICATIONS

"A220 All–Wheel Steer Loader," Bobcat Company, 6 pages (Date Unknown).
"T190 G–Series Compact Track Loader," Bobcat Company, 3 pages (2001).
"T200 G–Series Compact Track Loader,"Bobcat Company, 2 pages (Date Unknown).
"463 Compact Skid–Steer Loader," Bobcat Company, 4 pages (Date Unknown).
"553 F–Series Skid–Steer Loader," Bobcat Company, 2 pages (Date Unknown).
"753 G–Series Skid–Steer Loader," Bobcat Company, 2 pages (Date Unknown).
"763 G–Series Skid–Steer Loader," Bobcat Company, 2 pages (Date Unknown).
"773 G–Series Skid–Steer Loader," Bobcat Company, 6 pages (Date Unknown).

(Continued)

*Primary Examiner*—Donald W. Underwood
(74) *Attorney, Agent, or Firm*—Merchant & Gould P.C.

(57) ABSTRACT

A material handling apparatus is described including a vehicle having a front end, a rear end, a left side, a right side, a chassis, and a ground engagement device attached to the chassis for providing movement of the vehicle across ground; an engine constructed for propelling the vehicle; a loader assembly; a hydraulic system constructed for driving the loader assembly; and operator area including a cage for protecting an operator located within the operator area, and controls for controlling movement of the vehicle and for controlling operation of the loader assembly; and a forward tools area extending from the operator seating area to the front end of the vehicle. The material handling apparatus can include an entrance to the operator area through the rear end of the vehicle, a loader assembly that includes a tower that rotates relative to the chassis, and a dump box or work platform provided in the forward tools area. A method for operating a material handling apparatus is provided.

29 Claims, 25 Drawing Sheets

U.S. PATENT DOCUMENTS

| | | | | | |
|---|---|---|---|---|---|
| 2,482,612 | A | | 9/1949 | Drott et al. | |
| 2,821,313 | A | | 1/1958 | Warner | |
| 2,845,192 | A | * | 7/1958 | Klaus | 414/487 |
| 3,215,292 | A | | 11/1965 | Halls | |
| 3,231,117 | A | | 1/1966 | Melroe et al. | |
| 3,338,438 | A | | 8/1967 | Holtkamp | |
| 3,356,240 | A | | 12/1967 | Zink | |
| RE26,718 | E | * | 11/1969 | Kelly | 405/180 |
| 3,651,971 | A | | 3/1972 | McGuinness | |
| D224,588 | S | | 8/1972 | Bauer | |
| 3,685,675 | A | | 8/1972 | Sundberg | |
| 3,765,554 | A | | 10/1973 | Morrison | |
| 3,794,191 | A | | 2/1974 | Kuhn | |
| D231,482 | S | | 4/1974 | Bauer | |
| 3,937,339 | A | | 2/1976 | Geis et al. | |
| 3,963,131 | A | | 6/1976 | Dimmer | |
| 3,985,250 | A | | 10/1976 | Mononen | |
| 3,995,761 | A | | 12/1976 | Hurlburt | |
| 4,055,262 | A | | 10/1977 | Bauer et al. | |
| 4,068,771 | A | | 1/1978 | Zimmerman | |
| D247,814 | S | | 5/1978 | Johnson et al. | |
| 4,117,944 | A | | 10/1978 | Beckstrom et al. | |
| 4,122,960 | A | | 10/1978 | Bauer et al. | |
| D251,088 | S | | 2/1979 | Johnson et al. | |
| 4,166,712 | A | * | 9/1979 | Oberg | 414/680 X |
| 4,207,022 | A | | 6/1980 | Castel | |
| 4,260,320 | A | | 4/1981 | Steiger | |
| 4,363,151 | A | | 12/1982 | Knowlton | |
| 4,705,449 | A | | 11/1987 | Christianson et al. | |
| RE33,131 | E | | 12/1989 | Morrison | |
| D317,926 | S | | 7/1991 | Lynnes et al. | |
| D322,792 | S | | 12/1991 | Park | |
| 5,182,057 | A | | 1/1993 | Johnson | |
| 5,240,366 | A | | 8/1993 | Bamford | |
| 5,609,464 | A | | 3/1997 | Moffitt et al. | |
| 5,613,822 | A | | 3/1997 | Gasparini et al. | |
| 5,618,155 | A | | 4/1997 | Tighe | |
| D405,098 | S | | 2/1999 | Andrews et al. | |
| D406,594 | S | | 3/1999 | Miller et al. | |
| D407,415 | S | | 3/1999 | Flatau et al. | |
| D407,416 | S | | 3/1999 | Miller et al. | |
| D407,417 | S | | 3/1999 | Miller et al. | |
| D407,418 | S | | 3/1999 | Miller et al. | |
| 5,885,053 | A | | 3/1999 | Deye | |
| D408,278 | S | | 4/1999 | Konop | |
| 5,921,743 | A | | 7/1999 | Slagter | |
| D419,568 | S | | 1/2000 | Baig et al. | |
| D423,521 | S | | 4/2000 | Walter et al. | |
| D428,425 | S | | 7/2000 | Ratcliffe | |
| 6,132,163 | A | | 10/2000 | Andrews et al. | |
| 6,146,081 | A | | 11/2000 | Anderson | |
| 6,322,151 | B1 | | 11/2001 | Dombek et al. | |
| 6,409,457 | B1 | * | 6/2002 | Korycan et al. | 414/501 |
| 2001/0040405 | A1 | | 11/2001 | Jansen et al. | |

OTHER PUBLICATIONS

"863 G–Series Skid–Steer Loader," Melroe Company, 6 pages (Date Unknown).
"873 G–Series Skid–Steer Loader," Bobcat Company, 6 pages (Date Unknown).
"883 G–Series Skid–Steer Loader," Bobcat Company, 2 pages (Date Unknown).
"Turbo 963 G–Series Skid–Steer Loader," Bobcat Company, 6 pages (Date Unknown).
"7000 Skid Loader, Introducing the World Biggest, Strongest, Fastest Skid Loader," http://www.gehl.com/const/7000skid/index.htm, 1 page (Last Printed Aug. 20, 2001).
"ASV—4810 Series," ASV Inc., 2 pages (Date Unknown).
"Attachments for Loaders/Excavators," Bobcat Company, 10 pages (Date Unknown).
Bently, J., "Attachments Blast Skid–Steer Loader Sales into Warp Drive," http://www.aednet.org/ced/mar98/skid_steer.htm, 2 pages (1996–2000).
"Bobcat Company/Worksaver/Fall 1999. New Bobcat 864 Track Loader Keeps Working When the Work Gets Tough," http://www.bobcat.com/worksaver/99fall/ws_99fall_new864.html, 5 pages (Fall 1999).
e–worldconstrction.com—the home for today's construction industry. Bobcat takes the skid steer a stage further, http://www.e–worldconstruction.com/indext.php3, 3 pages (Apr. 4, 2001).
"EZE–Trimmer attaches to your existing equipment, works like a dream and is priced right!," BrogEZE Manufacturing, 2 pages (Date Unknown).
"Factory–Installed Optional Equipment. Advanced Hand Controls," Melroe Company, 2 pages (Date Unknown).
"Factory–Installed Optional Equipment. Hydraulic Control Options," Bobcat Company, 2 pages (Date Unknown).
Griffin, J., "Niche Marketing Reaches the Skid–Steer Loader Market," http://www.aednet.org/ced/jul00/cover_story.htm, 4 pages (Jul. 2000).
"JCB Product Range," http://www.jcb.co.uk/products/product.asp?id=40, 2 pages (Date Printed Aug. 21, 2001).
Merwin, D., "Little Attachments Help Sell the Big Iron," http://www.aednet.org/ced/mar98/little_attach.htm, 5 pages (1996–2000).
Northcutt, G., "Erosion Control—It Pays to Think Small," http://www.forester.net/cc_9909_small.html, 13 pages (Copyright 1999–2001).
Northcutt, G., "Small Loaders are Big on Work," wysiwyg://43/http://www.forester.net/gec_0009_compact.html, Grading & Excavation Contractor, 12 pages (Sep./Oct. 2000).
"Sheyenne Tele–Boom," Sheyenne Tooling & Mfg., 4 pages (Date Unknown).
"Sheyenne Tele–Saw," Sheyenne Tooling & Mfg., 2 pages (Date Unknown).
Suzik, H., "Welcome to Skid–Steer Mania," http://www.aednet.org/ced/jul00/product_focus.htm, 3 pages (Jul. 2000).
"Thwaites Nimline 2000—1 Tonne Dumper," http://www.mrbeanheavyequipment.com/#1.25tondumper, M.R. Bean Heavy Equipment, 3 pages (Date Printed Dec. 31, 2001).
Dae Han Machinery Co., Ltd "JICO Skid Loader DHD–645" http://www.jicoloader.com/index_001/ html, 2 pages (Dec. 3, 2001).

* cited by examiner

MATERIAL HANDLING APPARATUS AND METHOD FOR OPERATING

FIELD OF THE INVENTION

The invention relates to a material handling apparatus and to a method for operating a material handling apparatus. The material handling apparatus can be provided in the form of a compact loader.

BACKGROUND OF THE INVENTION

A general class of material handling apparatus that is commonly available and can be referred to as "compact loaders." In general, compact loaders have a rear mounted engine for providing a counterbalancing effect and are sized to have an operating capacity of between about 600 lbs. and about 3,800 lbs. and an engine horsepower range of between about 16 hp. and about 110 hp. Prior art compact loaders typically have an operator compartment located forward of the engine, and a boom assembly including a pair of lift arms extending along each side of the vehicle attached to rear towers and an attachment, such as, a bucket, provided at the end of the lift arms.

The general class of "compact loader" is recognized as including vehicles referred to as "skid steer loaders" and "compact track loaders." Skid steer loaders generally refer to those vehicles having wheels and tires, or having wheels and tires with tracks installed around the wheels and tires, that steer as a result of the tires or tracks skidding. Compact track loaders are similar to skid steer loaders but generally refer to those vehicles having a dedicated tracks system for ground engagement. Types of compact track loaders include multi-terrain loaders, all surface loaders, and all season vehicles. Exemplary compact track loaders are available from Takeuchi, Bobcat Company, and ASV Inc. which is an affiliate of Caterpillar. Another type of compact loader is commonly available and is generally referred to as an all-wheel steer loader. This type of vehicle is available from Bobcat Company. Compact loaders are available from numerous companies including Bobcat Company, JCB, Case, New Holland, Gehl, Caterpillar, John Deere, Takeuchi, ASV, and Daewoo.

Exemplary patents describing compact loaders include U.S. Pat. No. 4,055,262 to Bauer et al.; U.S. Pat. No. 4,705,449 to Christianson et al.; U.S. Pat. No. 6,132,163 to Andrews et al.; U.S. Pat. No. D-419,568 to Baig et al.; U.S. Pat. No. D-423,521 to Walter et al.; and U.S. Pat. No. D-231,482 to Bauer.

SUMMARY OF THE INVENTION

A material handling apparatus is provided according to the invention. The material handling apparatus includes a vehicle having a front end, a rear end, a left side, a right side, a chassis, and a ground engagement device attached to the chassis for providing movement of the vehicle across ground; an engine constructed for propelling the vehicle; a loader assembly; a hydraulic system constructed for driving the loader assembly; and an operator area including controls for controlling movement of the vehicle and for controlling operation of the loader assembly. The material handling apparatus can include a forward tools area extending from the operator seating area to the front end of the vehicle. The forward tools area can include a dump box or a work platform. The material handling apparatus can include an entrance to the operator area through the rear end of the vehicle. The material handling apparatus can include a rear implements area provided at the rear of the vehicle and can include a hitch and a power take-off (PTO). The loader assembly can include a tower that rotates relative to the chassis.

A method for operating a material handling apparatus is provided according to the invention. The method can include loading material into a bucket attached to a loader assembly provided on the material handling apparatus, moving the bucket to a position over the dump box, and opening the bucket to cause material to drop from the bucket into the dump box. The method can include loading an object onto a work platform or into a dump box on the material handling apparatus.

DETAILED DESCRIPTION OF THE INVENTION

Figure 1:
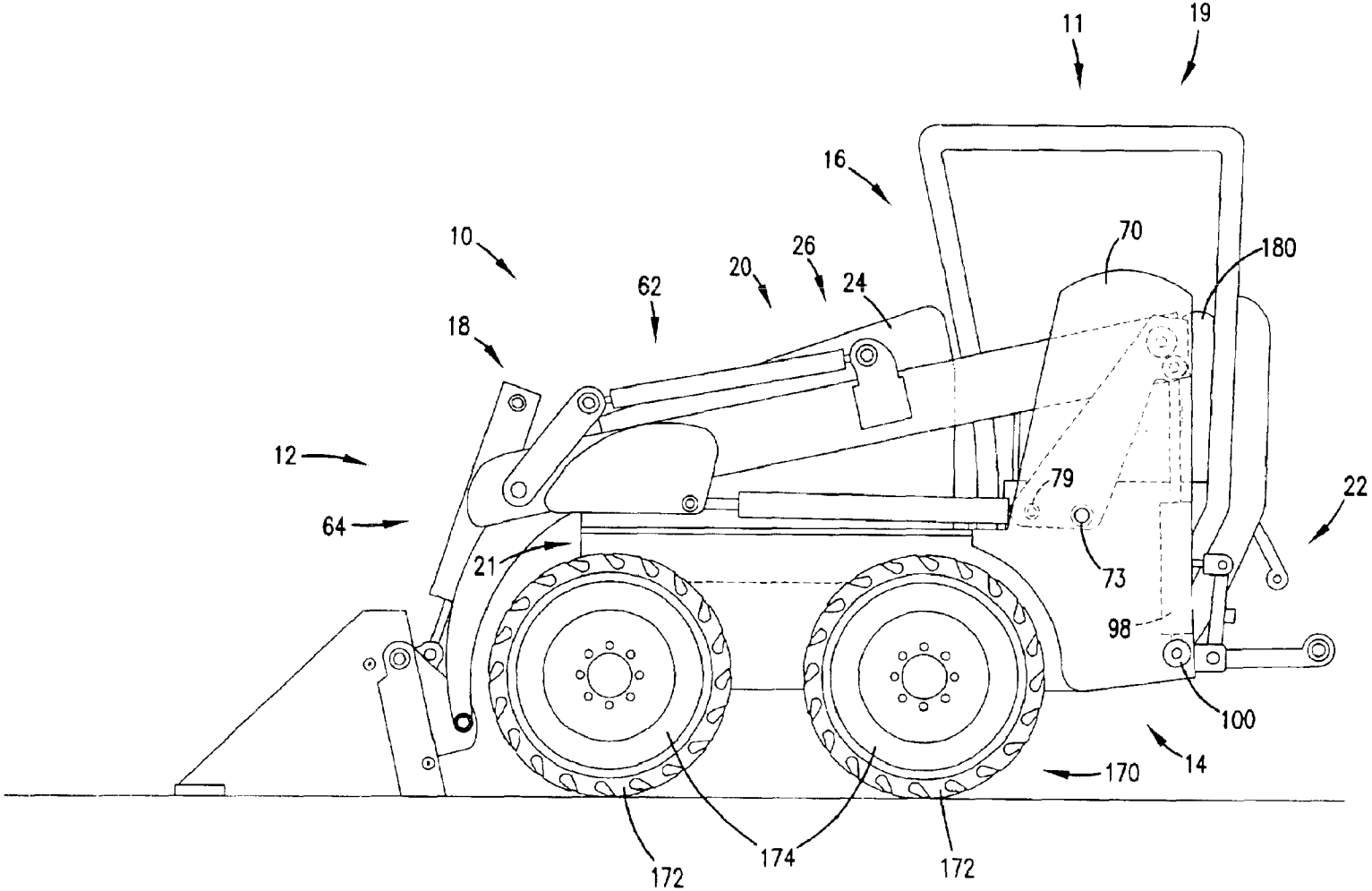
FIG. 1 is a side view of a compact loader according to the principles of the present invention.

A material handling apparatus is provided according to the invention. The material handling apparatus of the invention can be a type of vehicle that falls within the general class referred to as "compact loaders." Compact loaders are known to many in the industry as including vehicles referred to as skid steer loaders, compact track loaders, and wheel steer loaders. Skid steer loaders generally describe those types of compact loaders having a rear mounted engine for counterbalancing effect, and includes wheels and tires or wheels and tires with tracks installed around the wheels and tires. Compact track loaders generally refer to compact loaders having a dedicated track system for ground engagement. Compact track loaders include those compact loaders that are often referred to as multi-terrain loaders, all surface loaders, and all season vehicles. All-wheel steer loaders include those types of compact loaders that allow for the front and the back wheels to turn in opposite directions to provide steering. Many all-wheel steer loaders can switch between a conventional skid steer steering mode and an all-wheel steering mode Exemplary compact loaders according to the invention can be rated as having an operating capacity in the range of about 600 lbs. to about 3,800 lbs. The operating capacity of a compact loader is defined as half the load required to cause the compact loader to tip forward when lifting with a standard digging bucket according to SAE Standard J818.

Referring to FIGS. 1–5, a compact loader according to the invention is shown at reference numeral 10. The compact loader 10 is a skid steer loader 11. It should be understood that although a skid steer loader is shown, the compact loader according to the invention can be any type of compact loader including a compact track loader and an all-wheel steer loader.

The compact loader 10 includes three general areas or regions. These areas or regions include a tools region 12, a propulsion and powering region 14, and a controls region 16. It should be understood that these regions are not necessarily located in discrete or isolated areas. Certain regions may overlap and may be found throughout the compact loader 10 and reflect the type of function that can occur in that region. The characterization of the three different regions is provided for assisting in the description of the compact loader 10 and its operation.

The Tools Region

The tools region 12 includes those areas in which tools and/or implements can be located or attached if it is desirable to have the tools or implements located in those areas. The tools region 12 can include a loader attachment area 18, a forward tools area 20, and a rear tools area 22. The three areas can be used for coordinating and/or combining work tasks with different types of tools, implements, apparatus, or devices which can significantly expand the work capability and usefulness of the compact loader 10. The various types of equipment shown attached to the compact loader 10 in various alternative embodiments of the invention are provided for illustrating the scope of utility of the compact loader 10 in using tools, implements, apparatus, and devices singly or simultaneously.

The forward tools area 20 is provided as a site for locating tools and/or implements that facilitate certain tasks. This area is referred to as the "forward tools area" because it is located in front of the operator of the compact loader 10 when the operator is facing forward. The forward tools area 20 can be considered as extending from the operator area 19 to the vehicle front end 21. In addition, the forward tools area can extend between the vehicle left side 23 and the vehicle right side 25. The operator area 19 can be considered as being provided between the forward tools area 20 and the vehicle rear end 27.

Figure 2:
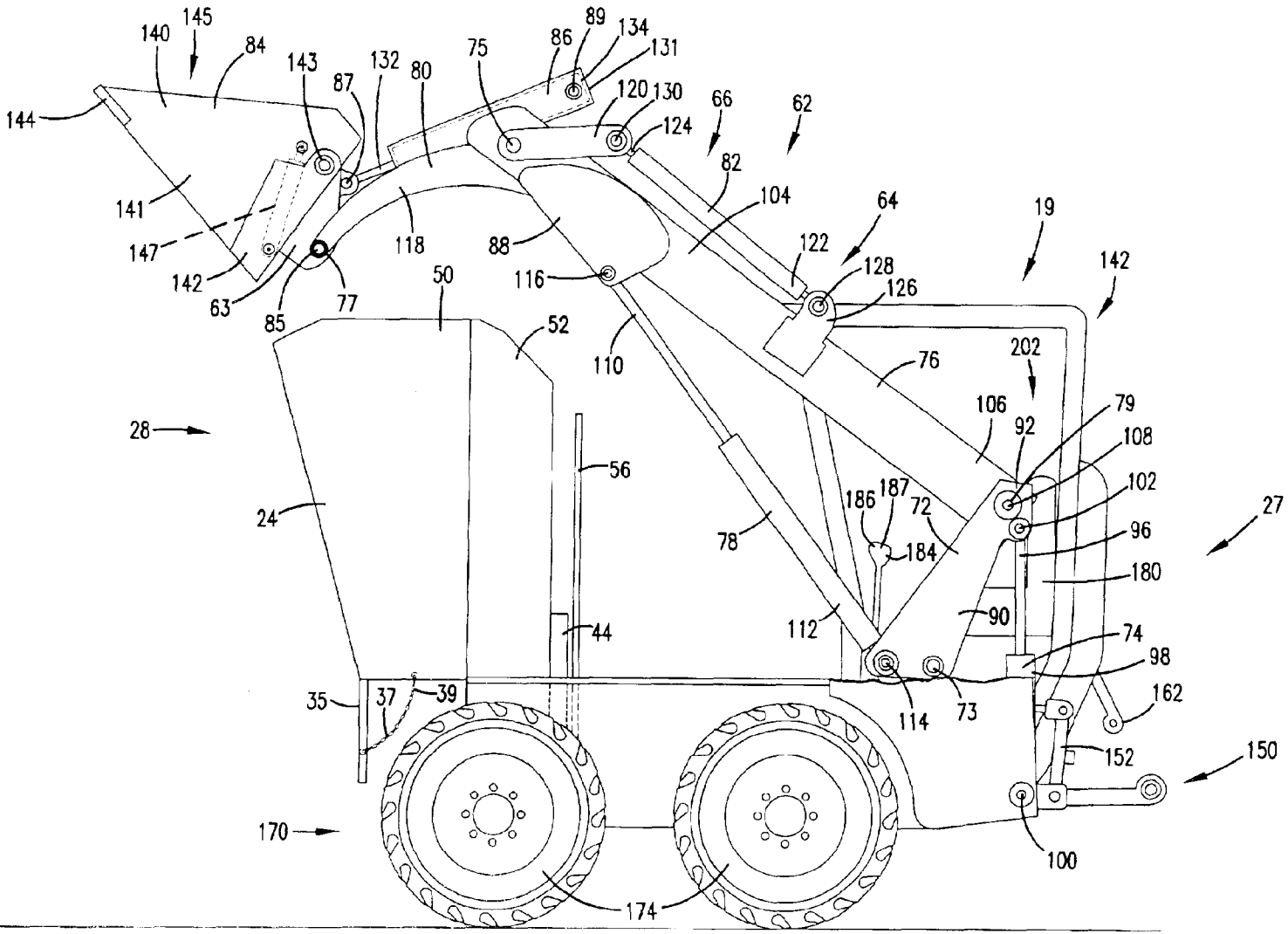
FIG. 2 is a side view of the compact loader of FIG. 1 shown in a different configuration.
Figure 3:
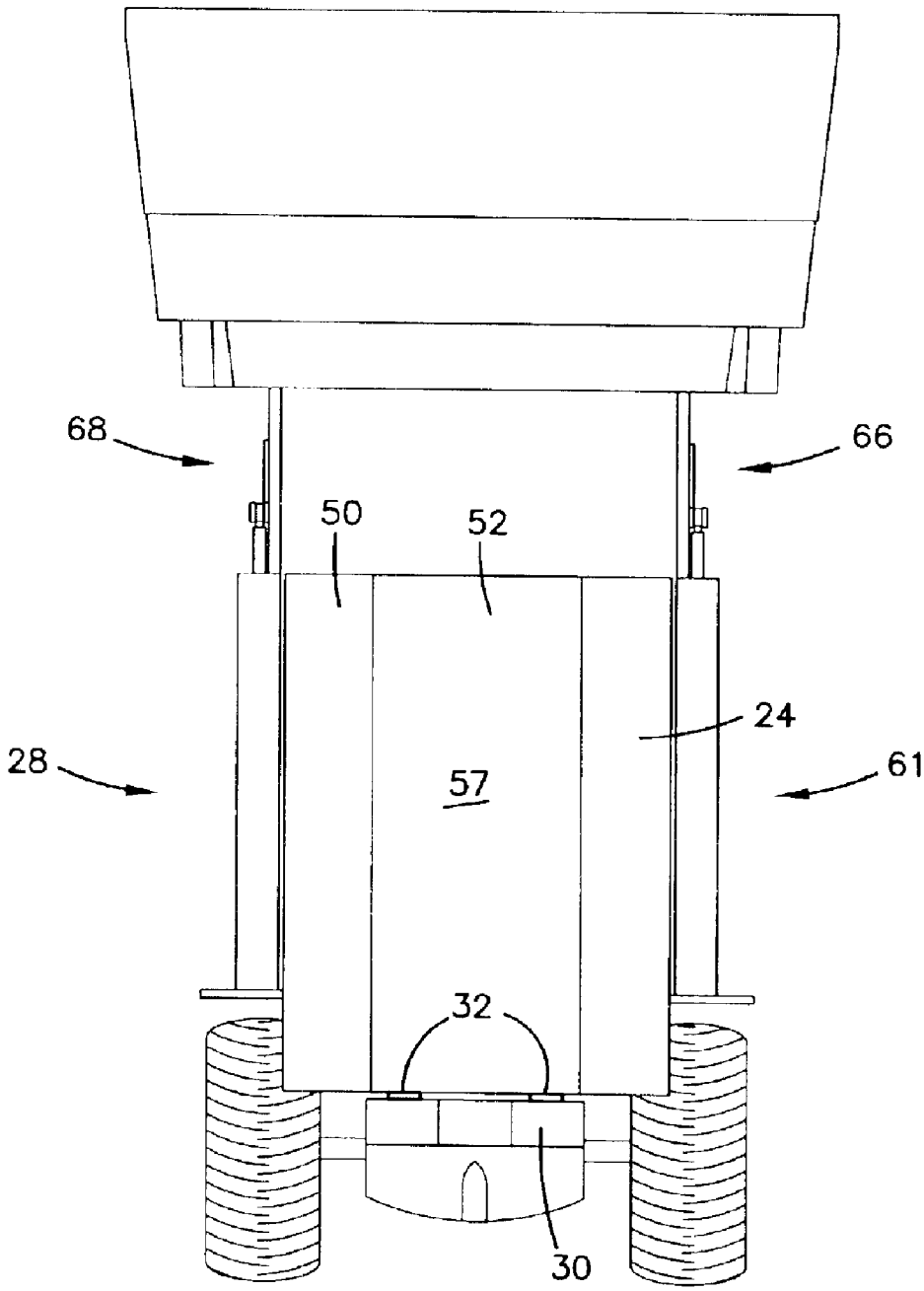
FIG. 3 is a front view of the compact loader of FIG. 1.
Figure 5:
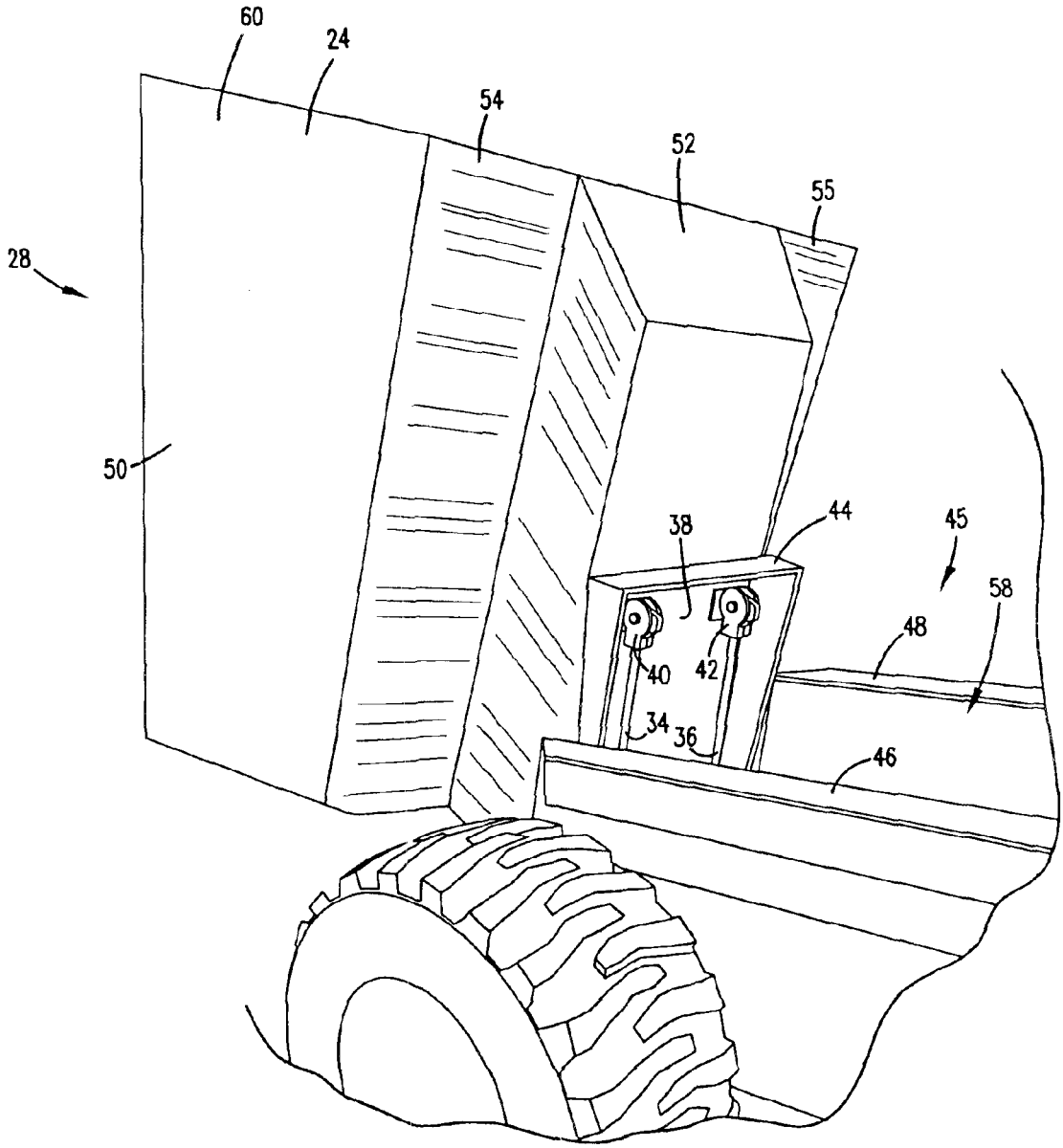
FIG. 5 is a partial perspective view of the compact loader of FIG. 1.

A dump box 24 is an exemplary tool or implement that can be provided at the forward tools area 20. The dump box 24 can be moved between a hauling position 26 (FIG. 1) and a dumping position 28 (FIGS. 2, 3, and 5). The dump box 24 can be attached to the chassis 30 via hinges 32. Hydraulic cylinders 34 and 36 can be attached to the dump box 24 along the bottom side 38 to provide movement of the dump box 24 between the hauling position 26 and the dumping position 28. The hydraulic cylinders 34 and 36 can attach to the bottom side 38 at the hydraulic cylinder connections 40 and 42. A skirt 44 can be provided around the hydraulic cylinder connections 40 and 42 to help screen away debris. The hydraulic cylinders 34 and 36 include a second end (not shown) that attaches to the chassis 30. By activating the hydraulic cylinders 34 and 36, the dump box 24 can be rotated about the hinges 32 to cause a load within the dump box 24 to flow out under the force of gravity. It should be understood that the reference to the chassis 30 refers to the supporting structure of the compact loader 10. In addition, the characterization that the dump box 24 and the hydraulic cylinders 34 and 36 attach to the chassis 30 should be understood to mean that the dump box 24 and the hydraulic cylinders 34 and 36 connect to the chassis 30 either directly or indirectly. In the context of the invention, items attached to the chassis can be considered as attaching directly to the chassis or attaching to something else that attaches to the chassis.

The dump box 24 can include a tailgate 35 that swings open to control the flow of materials out of the dump box 24. The tailgate 35 can be conveniently removable from the dump box 24. In addition, a tailgate control device 37 can be provided to controllably restrain the movement of the tailgate 35 to regulate the flow of materials when dumping and to prevent the flow of materials when hauling. An exemplary tailgate control device 37 is a chain 39. The type of materials that can be provided within the dump box 24 includes any material commonly found in dump boxes including dirt, gravel, stones, sand, debris, grain, manure, etc.

Figure 6:
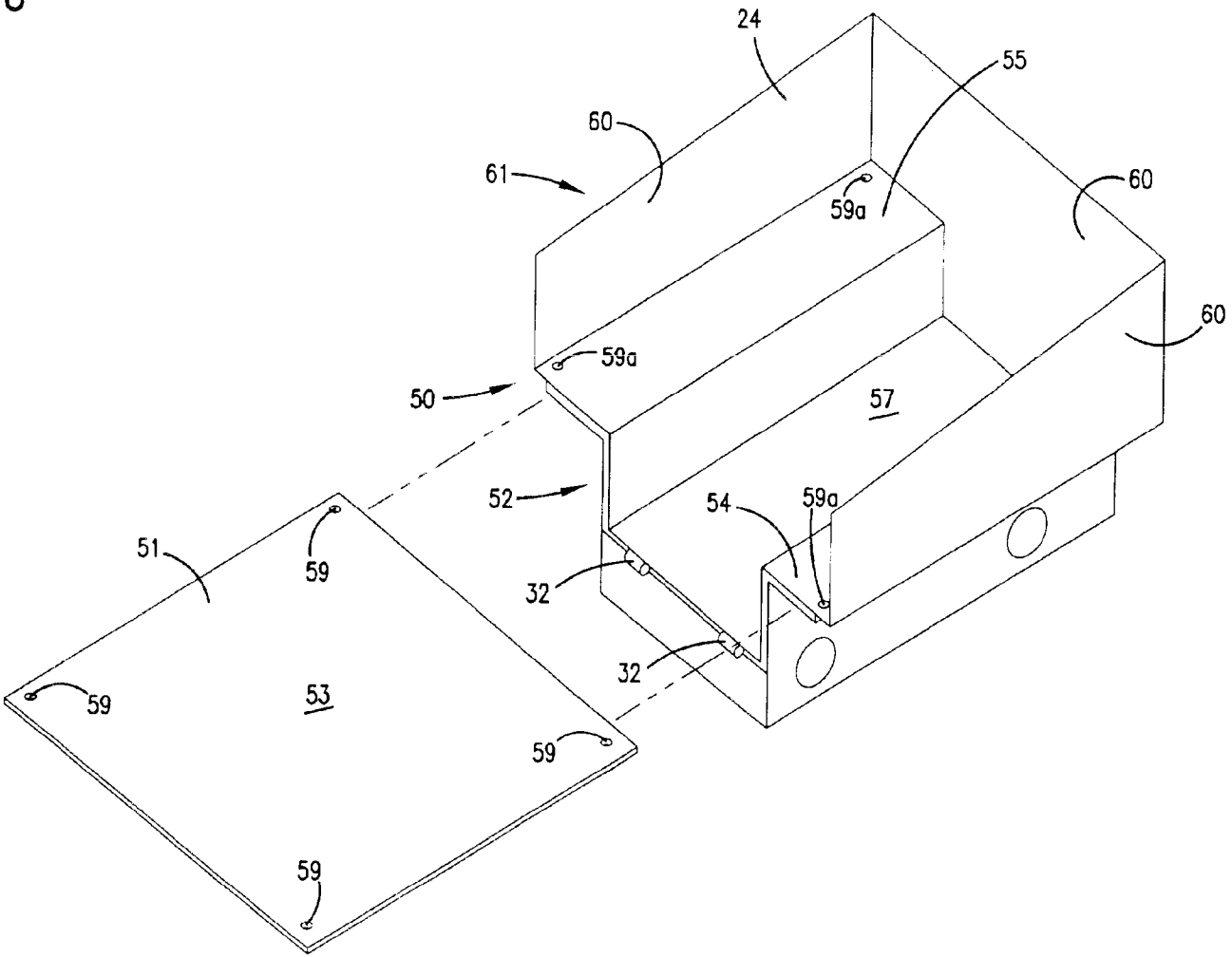
FIG. 6 is a perspective view of the dump box of FIG. 1.

The dump box 24 is shown having a configuration that allows a portion of the dump box to fit within the vehicle body 45 between the left vehicle body side 46 and the right vehicle body side 48, and another portion of the dump box to rest on top of the left vehicle body side 46 and the right vehicle body side 48. And advantage of having the dump box 24 provided with a configuration that allows it to fit within the vehicle body 45 is that it is believed that additional capacity can be achieved. Another advantage is a general lowering of the center of gravity of a load provided in the dump box 24. The dump box 24 includes a main box area 50 and a secondary box area 52. When the dump box 24 is provided in the hauling position 26, the secondary box area 52 fits between the left vehicle body 46 and the right vehicle body 48, and the main box area 50 rests above the left vehicle body 46 and the right vehicle body 48. By providing the dump box 24 with a main body area 50 and a secondary box area 52, it is possible to increase the hauling capacity and lower the center of gravity of the load compared with having only the main body area 50 as the dump box. As shown in FIG. 6, if it is desirable to provide a relatively flat bottom surface in the dump box 24, a removable floor 51 can be provided across the shoulders 54 and 55 of the main body area 50 to provide a flat bottom surface 53 on the inside of the dump box 24. The floor 51 can be provided by a wood board, a metallic sheet, or other rigid material and can be fastened in place via the fastener holes 59 in the floor 51 and the fastener holes 59*a* in the shoulders 54 and 55 allowing the floor 51 to be attached and removed fairly easily. It should be understood that the dump box can be constructed so that it does not include the secondary box area 52. That is, the dump box can be constructed so that the bottom surface is relatively flat similar to the bottom surface 53.

A protective cover 56 can be provided for covering the internal area 58 between the left vehicle body 46 and the right vehicle body 48. The interior area 58 can contain various components or parts such as the transmission case (not shown), hydraulic lines (not shown), etc. The protective cover 56 can be provided for protecting the components in the interior area 58 from debris. The protective cover 56 can be referred to as a transmission cover when it covers the transmission. It is advantageous to provide a protective cover 56 that can be easily removed to provide access to the interior area 58. The protective cover 56 can be attached to the vehicle body 44 and rotated out of the way to access the interior area 58 as shown in FIG. 2 or lifted out of the way.

The dump box 24 can be used to hold materials such as gravel, stones, dirt, sand, grain, debris, manure, etc. The capacity of the dump box can vary depending upon the desired size of the dump box side walls 60 and by controlling the size of the floor 57 and shoulders 54 and 55 (or the floor 51). In general, the capacity of the dump box will depend on the size of the compact loader. The capacity of the dump box can be provided to hold about 3 to 4 loads from the loader bucket associated with the compact loader. The dump box 24 can be considered a five sided dump box because it has four sides (including a tailgate) and a floor. It should be understood that the phrase "five sided dump box" refers to a container that generally has an open top 61. That is, there can be additional sides or a single side can have multiple angles as long as the dump box forms a container capable of holding materials that can be loaded into the container through the open top 61. Of course, a cover can be provided over the open top 61 in order to help hold materials within the dump box during transport or to protect the materials from, for example, weather.

The loader attachment area 18 includes a loader assembly 62. The loader assembly 62 can be provided as a pair of booms 64 including a left boom 66 and a right boom 68. It is expected that many compact loader designs according to the invention will be provided with a pair of booms rather than a single boom because it is believed that a pair of booms provide better control and stability. It should be understood, however, a compact loader according to the invention can be provided with a single boom. For the purpose of discussing the loader assembly 62, the description will focus on the left boom 66 and it should be understood that a similar structure can be provided as the right boom 68.

A loader assembly outside cover 70 and a loader assembly inside cover 71 can be provided to support a rotation connection 73 about which the tower 72 can rotate. In addition, the loader assembly outside cover 70 and the loader assembly inside cover 71 can help conceal the loader assembly 62 and helps keep debris or other foreign materials away from the moving parts. In FIG. 2, a portion of the loader assembly outside cover 70 and the loader assembly inside cover 71 are removed for illustration purposes.

The left boom 66 includes a tower 72, a tower cylinder 74, a lift arm 76, a lift arm cylinder 78, an attachment arm 80, an attachment arm cylinder 82, an attachment-84, and an attachment cylinder 86. The attachment arm 80 and the lift arm 76 rotate relative to each other about the rotation connection 75 by the movement of the attachment arm cylinder 82. The attachment 84 and the attachment arm 80 rotate relative to each other about the rotation connection 77 by the action of the attachment cylinder 86. The attachment arm 76 and the tower 72 rotate relative to each other about the rotation connection 79 by the movement of the lift arm cylinder 78. The tower 72 rotates relative to the chassis 30 about the rotation connection 73 by the operation of the tower cylinder 74.

The tower 72 includes a first tower end 90 and a second tower end 92. The first tower end 90 is attached to the compact loader at the rotation connection 73. The tower cylinder 74 includes a first tower cylinder end 96 and a second tower cylinder end 98. The second tower cylinder end 98 is attached to the compact loader via the rotation connection 100. It should be understood that the compact loader and the chassis can be referred interchangeably when characterizing the portion of the compact loader that attaches to the rotation connection 73 and the rotation connection 100. In general, the chassis 30 provides support for the compact loader, and if the rotation connections 73 and 100 are not directly attached to the chassis 30, they are attached to a structure that eventually attaches to the chassis 30. The first tower cylinder end 74 attaches to the first tower end 92 at the rotation connection 102. Extension or contraction of the tower cylinder 74 causes the tower 72 to rotate about the rotation connection 73.

The lift arm 76 includes a first lift arm end 104 and a second lift arm end 106. The first tower end 92 attached to the second lift arm end 106 at the rotation connection 108. The lift arm cylinder 78 includes a first lift arm cylinder end 110 and a second lift arm cylinder end 112. The second lift arm cylinder end 112 attaches to the second tower end 90 at the rotation connection 114, and the first lift arm cylinder end 110 attaches to the knee 88 at the rotation connection 116. The knee 88 is attached to and forms a part of the lift arm 76 at the first lift arm end 104 so that the knee 88 does not rotate relative to the lift arm 76. Extension or contraction of the lift arm cylinder 78 causes the lift arm 76 to rotate relative to the tower 72 about the rotation connection 108. The knee 88 can be viewed as an extension of the lift arm 76.

The attachment arm 80 includes a first attachment arm 118 and a second attachment arm 120. The second attachment arm 120 can be configured so that it extends to both sides of the lift arm 76 to provide additional support. An extension 123 (see FIG. 9) attaches the second attachment arm 120 to the first attachment arm 118. Accordingly, the first attachment arm 118 and the second attachment arm 120 move together about the rotation connection 75. The structure of the attachment arm 80 can be understood by considering that the left boom 66 and the right boom 68 attach to the compact loader 10 at the rotation connection 73 and is provided extending over the wheels 174. The booms can be characterized as extending directly over the wheels or other ground engagement device when they are provided in the same vertical plane. Many prior art compact loaders have booms that are located inside of the wheels. Because the booms 66 and 68 are placed further outward on the left and right sides of the compact loader, it is desirable to have the attachment arm 80 extend toward the center of compact loader 10. Most attachments have a universal attachment mount that allows an attachment to be attached to the loader assembly of various commercially available compact loaders. Because the towers and lift arms of the left boom 66 and the right boom 68 are farther apart than many commercially available compact loaders, it is desirable for the attachment arms of the left boom 66 and the right boom 68 to extend toward the center of the compact loader 10 so that the loader assembly 62 can attach to a universal attachment mount 63 provided on the attachment 84. By providing the left boom 66 and the right boom 68 in a relatively parallel arrangement with the compact loader 10, extensions can be used between the second attachment arm 120 and the first attachment arm 118 so that the first attachment arm 118 will attach to a universal attachment mount. The attachment arm cylinder 82 includes a first attachment arm cylinder end 122 and a second attachment arm cylinder end 124. The first attachment arm end 122 attaches to the lift arm 76 via the lift arm extension 126 at the rotation connection 128. The lift arm extension 126 can be viewed as a part of the lift arm 76. The attachment arm cylinder second end 124 attaches to the second attachment arm 120 at the rotation connection 130. The extension or contraction of the attachment arm cylinder 82 causes the attachment arm 80 to rotate relative to the lift arm 76 about the rotation connection 75.

The first attachment arm 118 attaches to the universal attachment mount 63 at the rotation connection 85. For the compact loader shown in FIGS. 1–5, a single attachment cylinder 86 is provided for rotating the attachment 84 relative to the attachment arm 80. That is, the attachment cylinder 86 can be located relatively midway between the left boom 66 and the right boom 68. Of course, two or more attachment cylinders can be provided on the compact loader if it is desired to do so. The attachment cylinder 86 includes a first attachment cylinder end 132 and a second attachment cylinder end 134. The first attachment cylinder end 132 attaches to the attachment 84 at the rotation connection 87. The second attachment cylinder end 134 attaches to the cylinder housing 131 at the rotation connection 89. The cylinder housing 131 attaches to a cross member 133 that extends between the first attachment arm end 118 of the left boom 66 and the right boom 68. The crossmember 133 can be seen in FIG. 9. In addition, the configuration of the attachment arm 80 can be seen along with the first attachment arm 118, the second attachment arm 120 and the extension 123.

When the attachment 84 is provided as a bucket 140, the loader assembly 62 can be used to load materials such as gravel, stones, dirt, grain, sand, manure, etc. into the dump box 24. The loader assembly 62 can be operated so that the bucket 140 containing a load of materials can be moved rearwardly toward the operator area 19. While the bucket 140 is provided above the dump box 24, the bucket 140 can be operated causing the materials to flow into the dump box. The materials can flow from the bucket 140 into the dump box 24 so that the flow is into the dump box and not toward the operator area 19. The bucket 140 can be referred to as a clam shell bucket because it includes a forward member 141 and a rearward member 142 that can separate by rotating about the rotation connection 143 to allow the materials to dump therefrom. The separation is similar to that shown in FIG. 8. As shown in FIG. 2, the movement of the rearward member 142 relative to the forward member 141 can be controlled by the hydraulic cylinder 147. The hydraulic cylinder 147 can be provided as a pair of hydraulic cylinders on each side of the bucket 140. In addition, the hydraulic cylinder 147 is shown on the exterior of the bucket 140. The materials can enter the bucket 140 through the bucket opening 145 and over the bucket front lip 144. By separating the first bucket member 141 and the second bucket member 142, the materials can exit the bucket 140. In addition, materials can exit the bucket 140 by flowing over the bucket front lip 144.

In addition, the loader assembly 62 can be used to load and unload heavy materials such as a welder, a boulder, etc. into the dump box 24 or onto a tools platform provided in the forward tools area 20 in place of the dump box 24. In addition, the rotation of the tower 72 so that the tower second end moves toward the rear of the compact loader makes it more convenient to load materials into the dump box 24 using the bucket 140. Loading the dump box 24 or a tools platform by use of the loader assembly 62 can be referred to as "self-loading" because the load is placed into the dump box or onto a work platform by the compact loader 10. When the operator controls all steps in the "self-loading" operation, the process can be referred to as "manual self-loading." When an electrical arrangement such as a computer program controls portions of the "self-loading" operation, the process can be referred to as "auto loading." During manual self-loading, the operator can control the rearward movement of the loader assembly 62 and the generally down and rearward movement of the bucket 140 over the dump box 24 through separate operator control actions. The auto loading operation can allow the operator to trigger a signal that causes the loader assembly 62 to move the bucket 140 over the dump box 24. The operator can then control the movement of the bucket 140 to control the movement of the materials into the dump box 24. The auto loading feature can be computer driven to enhance the safe operation of the compact loader.

The rear tools area 22 can be provided as an area for attaching tools or implements. The rear tools area 22 is referred to as the rear tools area because it is located behind an operator sitting in the operator area 19 in an orientation facing the vehicle front end 21. The rear tools area 22 can include a hitch 150 and a hydraulic cylinder 152 that causes the hitch 150 to rotate. A cylinder cover (not shown) can be provided for covering the hydraulic cylinder 152. The hitch 150 can be hydraulically operated as a lift hitch 154 and can include lower lift arms 156 and 158 and can include a draw bar 160. The lift arms 156 and 158 can serve to limit the degree to which the compact loader can tip rearward. The lift hitch 154, when provided in a lowered position, can serve as a rear stabilizer 155 that can help limit the degree to which the compact loader can tip rearward when moving or when using some tools such as a front loader mounted auger that can tip the compact loader rearward during operation. Rear tipping can be controlled by adding other devices to the lower lift arms 156 and 158, such as pads (not shown) or a grouser bar (not shown) which helps to prevent the loader from being pulled towards the work when using, for example, a front loader mounted back hoe device. Accordingly, the hitch 150 can be used as a stabilizer or additional components can be attached at the location of the hitch 150 to provide stabilization. That is, the compact loader can include a structure provided in place of the hitch 150 or in combination with the hitch 150 to provide stabilization.

The hitch 150 with the attached hydraulic cylinder 152 can also include lower lift arms 156 and 158 and an upper arm 162 for use as a three-point hitch 164 for attaching and using three-point tools and implements. Exemplary three-point implements include a box scraper, a rear grading blade, etc. which can be provided for work and for rear stabilization through downward pressure on the rear implement instead of having to add an extra pair of commonly available rear stabilizers. During operations such as using a front loader mounted tree spade, it is often desirable to provide rear stabilization.

The rear tools area 22 can include a hydraulically or mechanically driven power takeoff (PTO) 166 for providing power for rear implements and/or tools. The rear implements hydraulic cylinder line 167 can be provided to operate the hydraulic cylinder provided on a rear implement.

The Propulsion and Powering Region

The propulsion and powering region 14 is provided for driving the compact loader 10 and for powering the various tools and/or implements attached to the compact loader 10. The propulsion and powering region 14 includes a ground engaging device 170, an engine (not shown), a hydraulic motor (not shown), an engine radiator (not shown), and a hydraulic motor radiator (not shown). The ground engagement device 170 can be tires 172 on wheels 174. Alternatively, the ground engagement device can be tracks around wheels or a dedicated track system. The engine can be attached at the rear of the compact loader to provide a counterbalancing effect. The engine can drive the hydraulic motor that powers the loader assembly 62 and other hydraulic devices, apparatuses or tools that run off of hydraulic power. The engine radiator and the hydraulic motor radiator provide cooling of the engine and the hydraulic motor, respectively.

The Controls Region

The controls region 16 is where the operator sits and controls the operation of the compact loader 10. The controls region 16 includes an operator seat 180, an engine radiator and/or hydraulic motor radiator cover 182, a vehicle steering control 184, a loader assembly and attachment control 186, a tools control 187 and a cage 188 for protecting the operator. It should be understood that various forms of steering controls can be provided. The vehicle steering control 184 can be referred to as a stick control and generally includes a left stick and a right stick. The left stick controls forward and rearward movement of the left wheels, and the right stick controls forward and rearward movement of the right wheels. Accordingly, by moving the left stick and the right stick, it is possible to steer the compact loader 10. The loader assembly and attachment control 186 can be used to operate the raising and lowering of the loader assembly 62 and the movement of the attachment 84. The tools control 187 can be mounted on the vehicle steering control 184, the loader assembly attachment control 186, or in some other location in the controls region 16. The tools control 187 can be used to operate the forward tools area 20 including the dump box and/or the tools platform. It should be understood that the various controls can be provided as hand and/or foot controls. Various controls configurations are available from different compact loader manufacturers including Bobcat Company, JCB, Case, New Holland, Gehl, Caterpillar, John Deere, Takeuchi, ASV, and Daewoo.

The area in which the operator sits and controls the compact loader 10 can be referred to as the operator area 19. The cage 188 extends over the operator area 19 to protect the operator against falling material or injury from a roll-over. The cage can be provided with protective mesh for additional protection and/or transparent panels for additional protection and to enclose the operator area 19 if it is to be heated and/or air conditioned. The operator seat 180 can be provided generally above the engine. The engine radiator and the hydraulic motor radiator can be provided behind the operator's seat 180. The cover 182 can include a louvered area 192 to provide for air to flow through for cooling the engine radiator and the hydraulic motor radiator. The cover 182 can be constructed so that it swings open to allow one access to the rear of the engine, the engine radiator, the hydraulics motor radiator, and other components such as filters, etc. The engine cover 182 can include rear lights 183.

Figure 4:
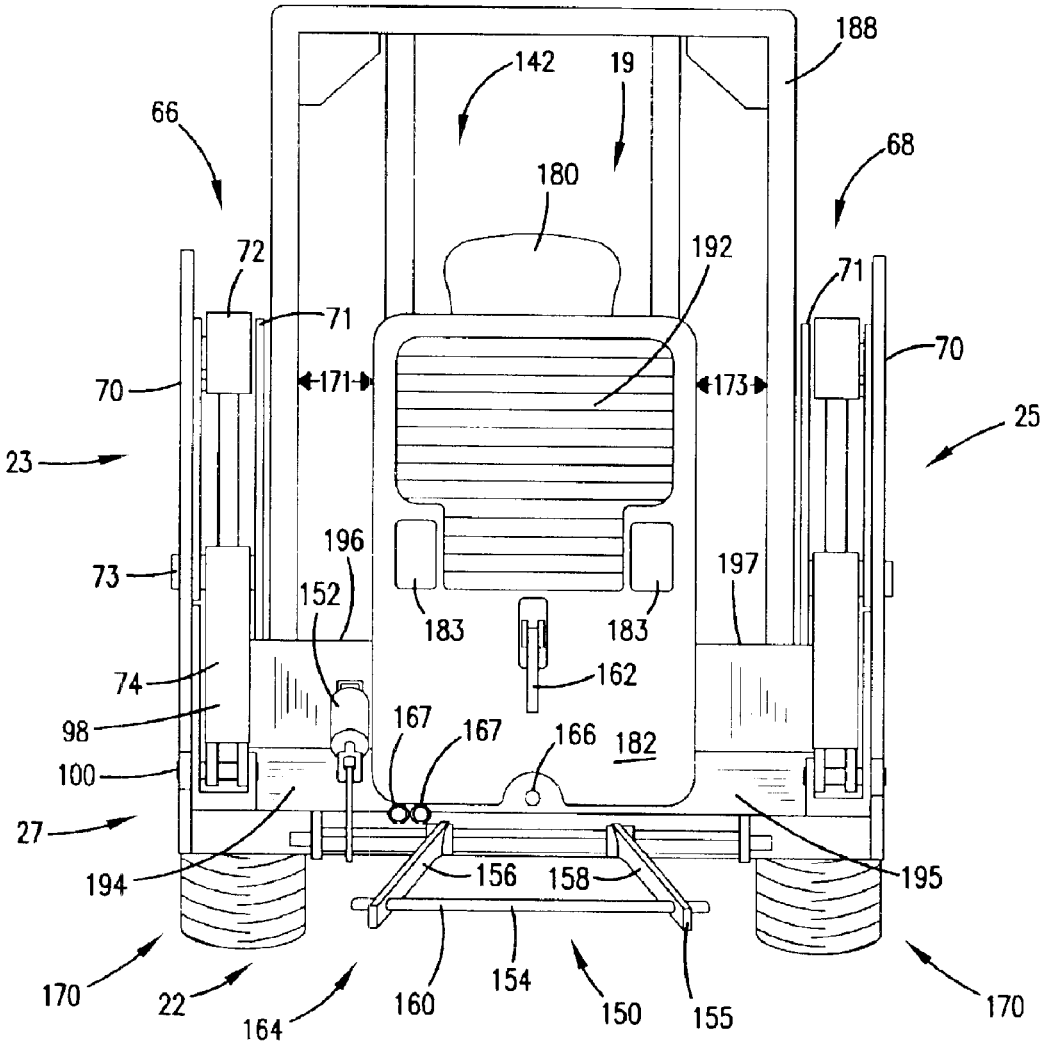
FIG. 4 is a back view of the compact loader of FIG. 1.

The operator area 19 can be accessed through the rear end 27 of the vehicle. An advantage of providing a compact loader with rear entry is that it removes the necessity to step over the loader assembly in order to gain access to the operator's seat. As shown in FIG. 4, an operator can step onto the entry step 194 provided between the operator's seat 180 and the left boom 66, and then step onto the operator's floor 196 provided within the operator area 19. Similarly, it is possible that the operator can access the operator area 19 by stepping onto the rear entry step 195 between the operator's seat 180 and the right boom 68, and then onto the operator's floor 197. An advantage of the compact loader 10 according to the invention is that the left boom 66 and the right boom 68 are provided over the ground engagement device 170 to provide a clearance area 171 between the left boom 66 and the operator's seat 180 and a clearance area 173 between the right boom 68 and the operator's seat 180. The clearance area 171 and 173 can have a width that allows a person to pass therethrough relatively easily. In many prior art compact loaders, the left boom and the right boom are located inside of the wheels or track. By providing the left boom 66 and the right boom 68 over the ground engagement device 170, it is possible to create the steps 194 and 195 that allow for rear entry of the vehicle. The compact loader according to the invention can have the same wheel base width and length as several prior art compact loaders and the boom arms can be placed over the ground engage device to provide access through the rear of the vehicle into the operator area. In comparison to prior art compact loaders, the compact loader according to the invention can have a widened operator compartment and a widened rear chassis area to accommodate the left boom and right boom over the ground engagement device.

The size of the left rear entry can be provided so that an operator can enter the compact loader from the rear end 192 by stepping onto the step 194 and then onto the floor 196 and walk around to the operator's seat 180 from the left side. The sizing of the right entry side can be provided so that the operator can enter the compact loader 10 from the rear end 192 by stepping onto the step 195 and then onto the floor 197 to walk to the operator's seat 180 from the right side. An intermediate stepping area can be provided somewhere between the steps 194 and 195 and the floor 196 and 197. It should be understood that the right entry side can be available for entry, the left entry side can be available for entry, or both sides can be available for entry. The right entry side or the left entry side can be used for the operator to enter the operator area 19 and the remaining side can be used for placing other components such as the radiator, a hydraulic fluids supply tank, etc.

It is pointed out that many commercially available compact loaders require front entry which means climbing over or around a front attachment if one is attached to the boom arms, then over a front boom crossmember before entering the operator area to be seated. It is believed that the rear entry method for entering the compact loader according to the invention is easier, safer, and more convenient than front entry techniques. In addition, the compact loader according to the invention can be entered from the front similar to many commercially available compact loaders. It is believed that a rear entry of a compact loader is simply more convenient than having to climb over or around a front attachment. Although the compact loader according to the invention can be constructed for rear entry and/or side entry into the operator area, the compact loader can be constructed for front entry similar to conventional compact loaders.

The compact loader 10 can be modified to allow for side entry into the operator area 19. For example, it is possible to move the tower 72 and the tower cylinder 74 forward to create a passageway for an operator to enter from outside the compact loader to inside the operator area 19. It should be understood that by moving the tower 72 and the tower cylinder 74 forward, it may be appropriate to modify the configuration of other components of the loader assembly 62. An advantage of providing for side entry into the operator area 19 is that additional equipment can be provided in the rear of the compact loader that would provide an obstruction to entry from the rear of the compact loader. By providing for side entry, an operator can step onto the steps 194 and/or 195 from the sides of the vehicle and then step up onto the floor 196 and/or 197.

Figure 20:
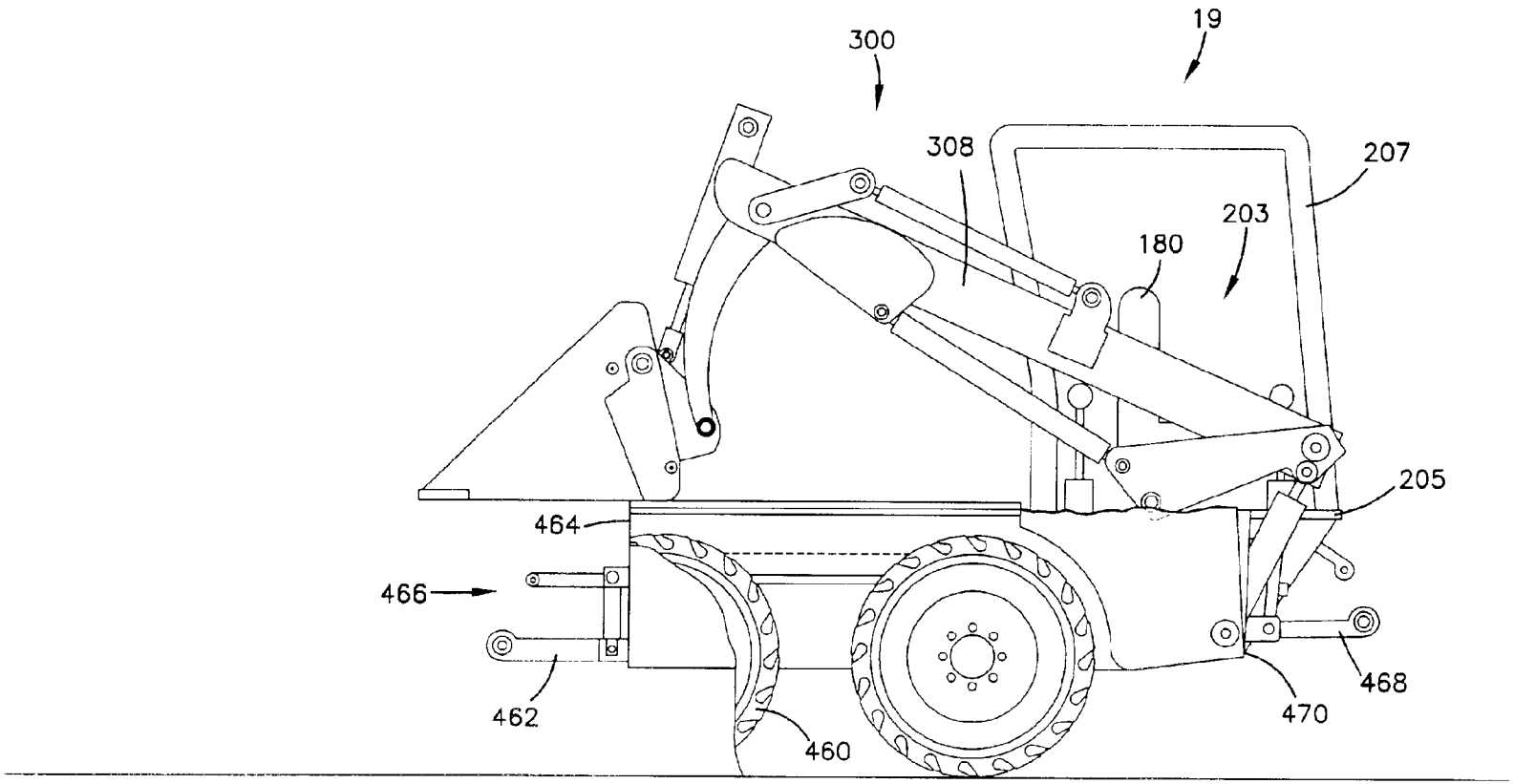
FIG. 20 is a side view of a compact loader according to the principles of the present invention.

The operator's seat 180 can be constructed so that it moves between a forward facing position 202 and a rearward facing position 203 (see FIG. 20). When provided in a forward facing position 202, an operator sitting in the operator's seat 180 faces toward the vehicle front end 21. When provided in a rearward facing position 203, an operator sitting in the operator's seat 180 faces toward the vehicle rear end 27 and can more easily operate tools and/or implements located in the rear tools area 22. When the operator area 19 is constructed so that the operator's seat 180 can be placed in a rearward facing position 203, the operator seating area 19 can be configured so that there is legroom for operator by extending the floor 205 and the cage 207 rearwardly. In addition, the operator area 19 can be constructed so that the controls for operating the vehicle and the tools or implements are available to an operator facing forward or rearward in the vehicle. Accordingly, if there is a tool or implement provided at the rear of the vehicle, such as a mower 504 (see FIG. 22), the operator can sit in the operator's seat 180 facing the mower 504. Optionally, the controls can be provided as movable controls which can plug into a boot, sleeve, connector, or socket type connector so that the controls can be installed and uninstalled in front of the operator's seat 180 or behind the operator's seat 180.

Commercially available compact loaders traditionally have the engine located in the rear of the compact loader and behind the operator in order to make the compact loader proportionally heavier in the rear than in the front when the compact loader is not carrying a load in the bucket. This is done to counterbalance the weight of a bucket and its load or to counterbalance the weight of another front mounted tool. In general, many commercially available compact loaders are manufactured having a weight ratio that is meant to shift relatively more weight from the rear of the machine to the front of the machine when carrying a load. This shifting of proportionally more weight from back to front and vice versa places more load on either the front or the rear of the ground engagement devices which allows the compact loader to turn on a relative point. Many manufacturers offer machines having different front and back machine weight ratios that provide varying degrees of turnability. A relatively evenly weighted compact loader would have a tendency to use more engine power when turning and the tracks or tires would tend to wear out more quickly. In general, many commercially available skid steer loaders are designed so that, without a load in the bucket, about 70% of the machine's weight is on the rear axles and about 30% is on the front axles. With most of the load on the rear axles, the machine turns or pivots on the rear wheels, and the front wheels skid right or left. Accordingly, many of these compact loaders are prone to tipping rearward when the bucket is empty because of their designed weight ratio which makes them generally unsuitable for pulling.

Figure 21:
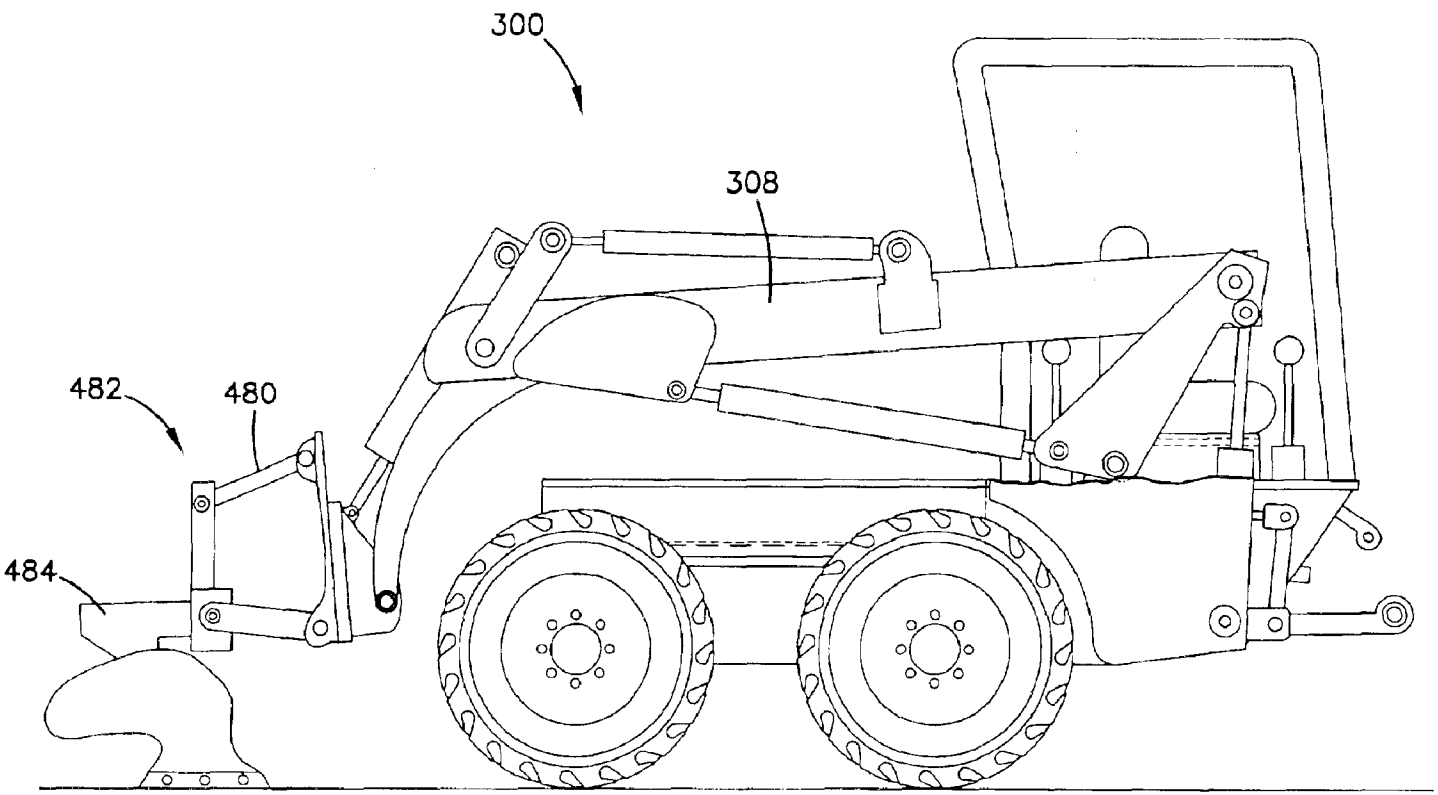
FIG. 21 is a side view of a compact loader according to the principles of the present invention.

One advantage of the compact loader according to the invention as shown in FIGS. 20–23 is the ability to drag or pull with a reduced tendency to tip rearward. The compact loader can be used for log skidding where other machines are too large and cannot maneuver easily. The compact loader according to the invention can be used for plowing when a plow 484 is provided attached to either a loader mounted three point hitch attachment device as shown in FIG. 21 or to a hitch 462 which may be attached to the front of the vehicle as shown in FIG. 20.

The compact loader can include an auto load operation where positioning of the bucket 140 over the dump box 24 is machine controlled. By providing an auto load operation, the operator can simply trigger a signal that causes the compact loader 10 to move the loader assembly 62 so that the load in the bucket 140 is automatically positioned over the dump box 24 for unloading. By providing an auto load operation, the operator can use a single control that coordinates the movement of the tower 72, the lift arm 76, and the attachment arm 80 so that the bucket 140 moves to a location above the dump box 24. The operator can then control the release of the bucket 140 causing the material to load into the dump box 24. When manually self loading, the operator initiates and coordinates at least two separate control movements. These control movements include elevating the bucket 140 and placing the bucket 140 over the dump box 24. An additional control movement that can be provided in both auto load operation and manual self loading includes releasing the materials from the bucket 140. The elevation of the bucket 140 can be accomplished by extending the lift arm cylinder 78, retracting the tower cylinder 74, or combination thereof. An advantage to using the tower cylinder 74 to elevate the bucket 140 is that the overall height of the bucket 140 can be limited. Moving the bucket 140 over the box can be controlled by the attachment arm cylinder 82 and, to a certain extent, by the other cylinders. It should be understood that any of the various cylinders can be operated to provide appropriate movement of the attachment 84 to a desired location.

In the auto load method a sensing source and controller can be used to provide control in the lift cycle and the movement of the attachment arm assembly in a manner which will position the bucket 140 over the dump box. The lift arm cylinder can be locked out or bypassed in the auto load method so the load can not be raised too high which could possibly tip the compact loader over backwards. The operator controls used in the auto load method can be a combination of hand and foot controls or hand controls only. Either a hand control or a foot control can be used in the auto load method. Also when the lift arm cylinder is locked out or bypassed in the auto load method the control means normally used for raising and lowering the loader boom (a foot control or hand control activation) can be automatically switched from its normal function of actuating the lift arm cylinders for lifting to actuating only the tower cylinder 116 which controls all lifting and lowering in the auto load method. Not using the lift arm cylinder 78 in auto loading would be convenient for the operator since the same controls for lift movements can be used while limiting the height for safety reasons. It should be understood however that a separate control means, such as a joystick and or lever, can also be provided for loader operations when using the auto load method.

Now referring to FIGS. 7–24, compact loaders according to the invention are shown equipped with various different tools and/or implements. It should be understood that these various tools and/or implements are provided as exemplary tools and/or implements that can be provided as part of the compact loader according to the invention. It is expected that many additional tools and/or implements in addition to those shown in FIGS. 7–24 can be provided as part of the compact loader according to the invention.

Figure 7:
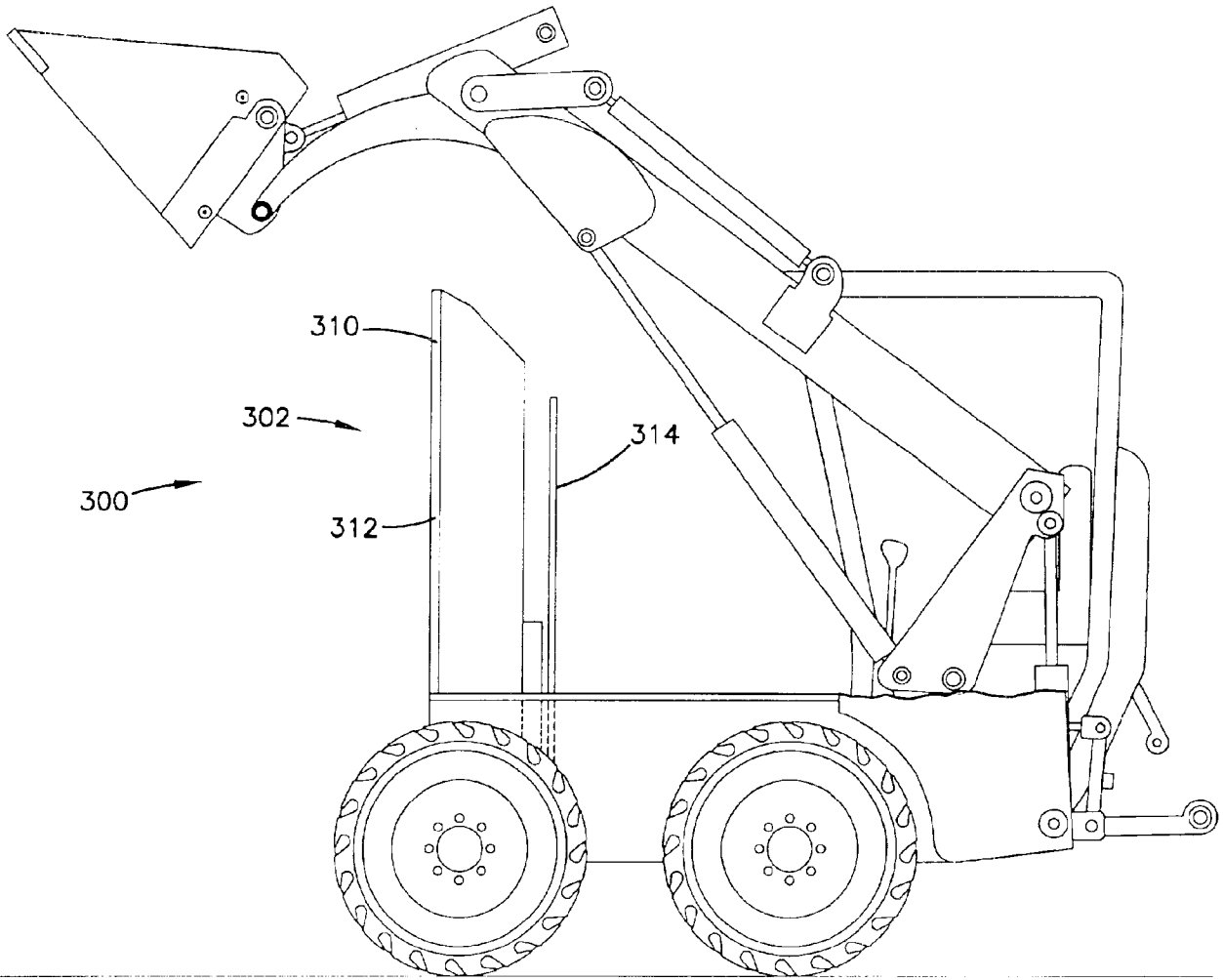
FIG. 7 is a side view of a compact loader according to the principles of the present invention.

FIG. 7 shows a compact loader 300 where the forward tools area 302 includes a work platform 310. It is expected that the work platform 310 may replace a dump box when desired. For example, certain types of loads can be carried more easily in the work platform 310 that may not necessarily fit within a dump box. The work platform 310 includes a floor 312 that may or may not have side walls extending above the floor 312. Items that can be carried on the floor 312 include concrete blocks, potted shrubs, a portable welder, etc. It should be understood that a dump box can additionally be mounted to the work platform 310 as an attachable dumping containing device.

The work platform 310 can have a configuration that allows a portion of the work platform to fit within the vehicle body similar to the dump box bottom floor shown in FIG. 6. Providing the work platform 310 in place of the dump box can reduce initial expense. In addition, the work platform 310 can provide basic lifting, lowering, dumping, carrying, and/or holding for other mountable devices, apparatuses, or tools which may or may not need lifting and lowering hydraulic actuation. A protective cover 314 can be provided under the work platform that can be raised allowing for servicing the underlying components. The protective cover 314 can also be removed. The work platform 310 can include an attachable and flat structure similar to that shown at reference numeral 53 in FIG. 6 if a flat surface is desired for stacking or hauling. In addition, the work platform 310 can have a dump box mounted onto it. The platform 310 can also be equipped with other tools, apparatuses, or devices, such as, a vacuum/blower device, a cement mixer, and a fluid distribution system.

Figure 8:
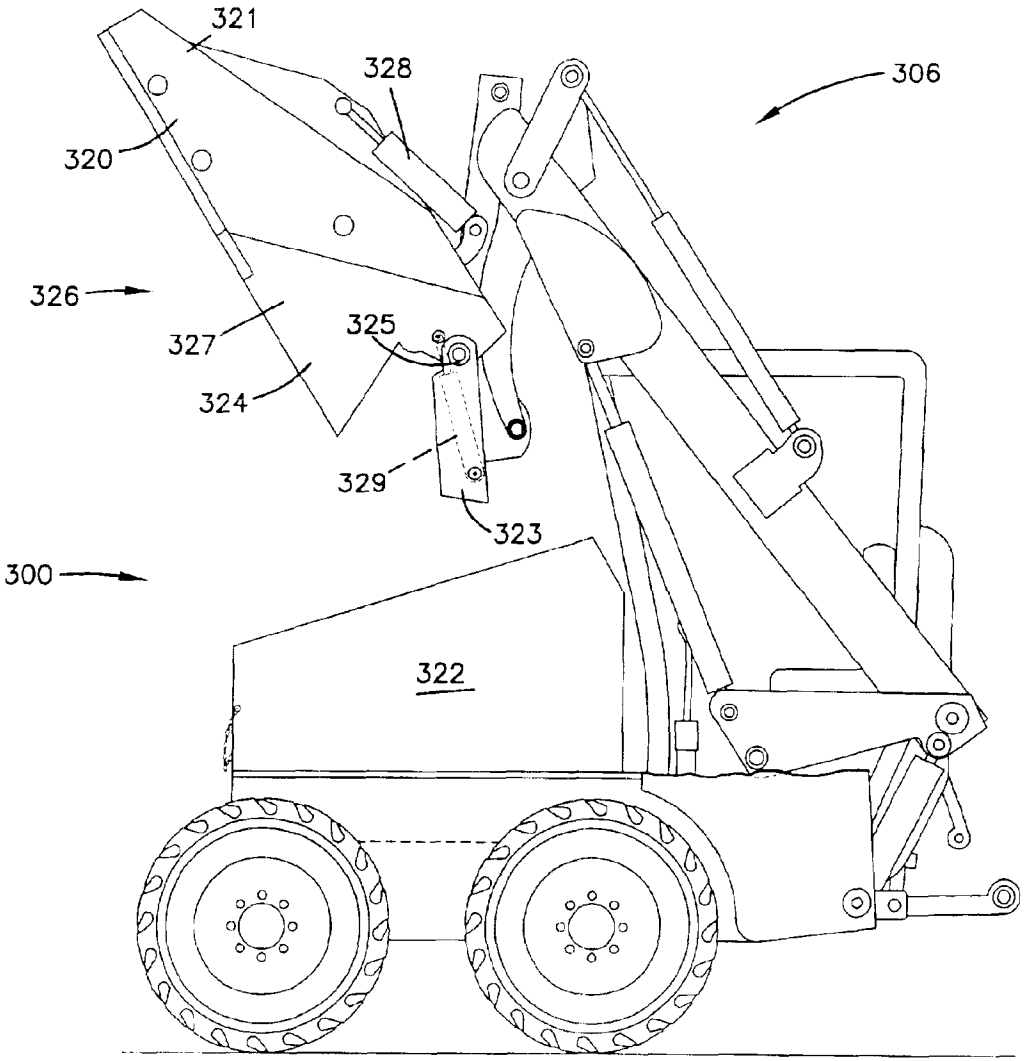
FIG. 8 is a side view of a compact loader according to the principles of the present invention.

FIG. 8 shows a compact loader 300 having a landscape rake 320 provided in the loader attachment area 306. The landscape rake 320 can be emptied of debris into the dump box 322. Landscape rakes often fill up with debris during use. Prior art compact loaders that utilize a landscape rake are often required to move to another location in order to dump the debris into a pile or into another structure. The compact loader 300 allows for the debris to be dumped into the dump box 322 and thereby allows for a quicker and more convenient completion of a project. The landscape rake 320 can be emptied in a manner similar to the bucket 140 shown in FIG. 2. The second member 323 rotates relative to the first member 324 about the rotation connection 325 to provide the landscape rake 320 in a dumping position 326. The second member 323 can be rotated relative to the first member 324 by one or more (preferably two) hydraulic cylinders 329. The hydraulic cylinder 328 is provided for rotating the landscape attachment portion 321 relative to the bucket portion 327 to allow for emptying the landscape rake 320.

Figure 9:
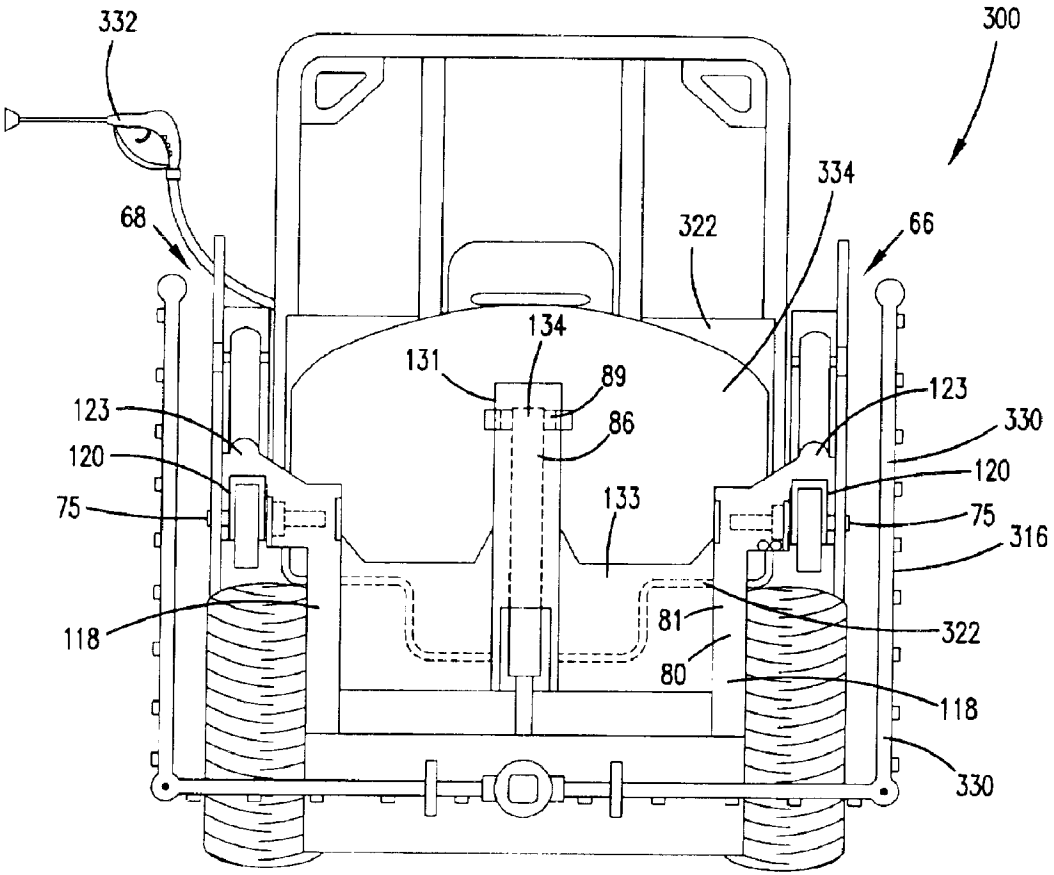
FIG. 9 is a front view of a compact loader according to the principles of the present invention.

FIG. 9 shows a compact loader 300 equipped with a boom spray assembly 330, a hand held sprayer 332, and a fluid tank 334 mounted in the dump box 322. The compact loader 300 can be used to provide fluid distribution. Exemplary types of fluid that can be distributed include water, insecticide, fertilizer, herbicide, etc. The fluid tank 334 can also be mounted on a work platform if a dump box is not available. In addition, a nozzle 335 can be provided to create a spray of fluid. For example, the compact loader 300 having the nozzle 335 can be used to control or suppress fires such as brush fires.

Figure 10:
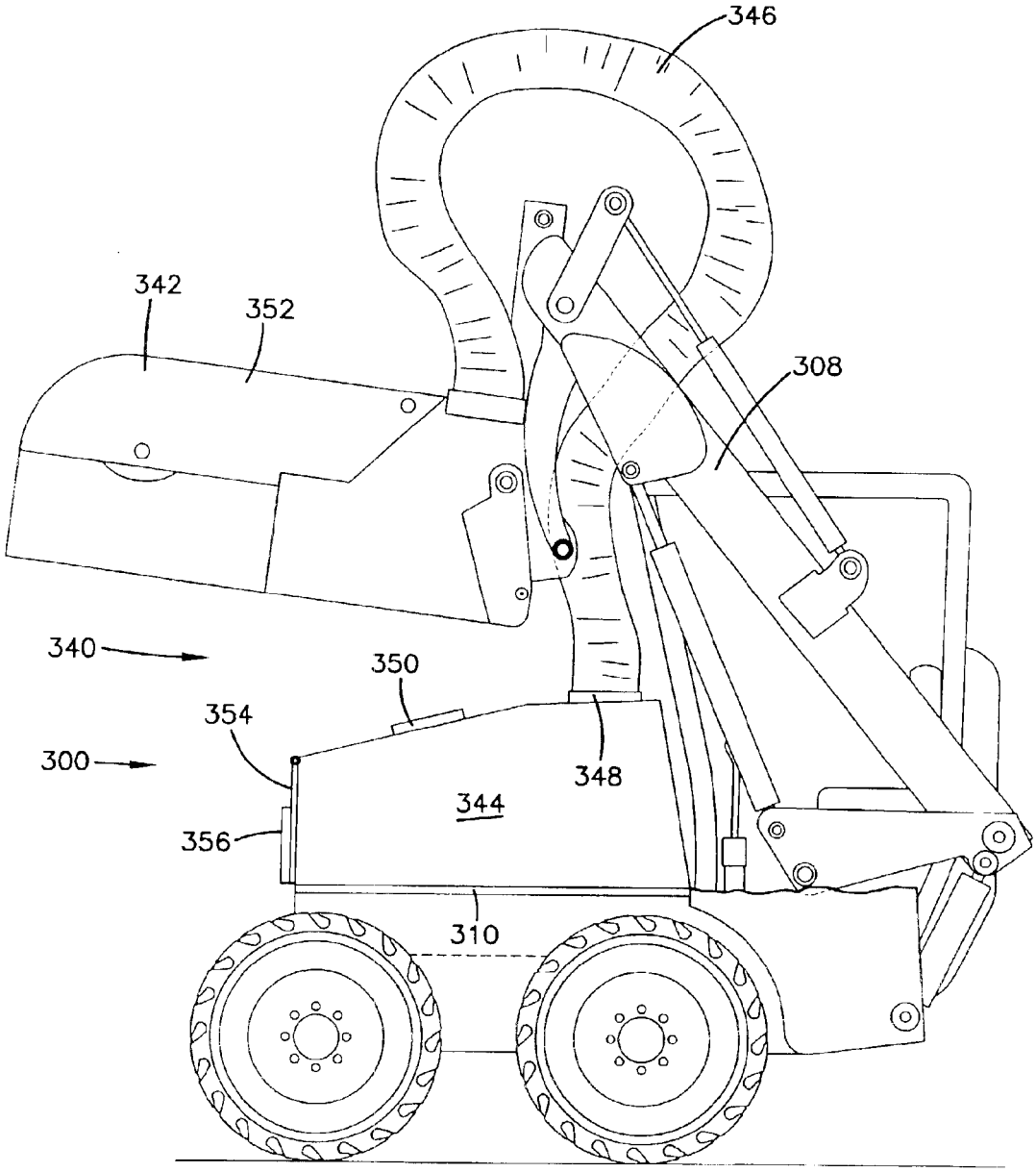
FIG. 10 is a side view of a compact loader according to the principles of the present invention.

FIG. 10 shows a compact loader 300 having a vacuum/blower device 340 mounted on the work platform 310 which can also be mounted in a dump box. The vacuum/blower device 340 can include a vacuum inlet/blower outlet 342 attached to the boom assembly 308, a vacuum/blower housing 344, and a hose 346 attaching the vacuum inlet/blower outlet 342 to the vacuum/blower housing 344. The hose 346 can be attached to the vacuum inlet 348 to provide a vacuum operation or the hose 346 can be attached to the blower outlet 350 to provide blower operation. The vacuum/blower device 340 can include a sweeper attachment 352 for sweeping up debris such as leaves and twigs. The vacuum/blower housing 344 can include a panel 354 for accessing the interior and cleaning out the interior. In addition, a purge port 356 can be provided which, when opened, allows debris to be blown out of the vacuum/blower housing 344.

The vacuum/blower device 340 can be used as a vacuum source to help reduce dust when using tools such as rock wheels for cutting hard surfaces such as cement, and when using planers, scrapers, or other device that generates dust and/or debris. In addition, the vacuum/blower device 340 can be used for picking up liquids. Vacuuming and/or blowing power supplied by the vacuum/blower device 340 can be used for vacuuming or blowing leaves, debris, corner dust, etc. when the hose 346 is detached and manipulated by hand. In addition, the vacuum/blower device 340 can be used for catching grass when attached to a mowing device.

Figure 11:
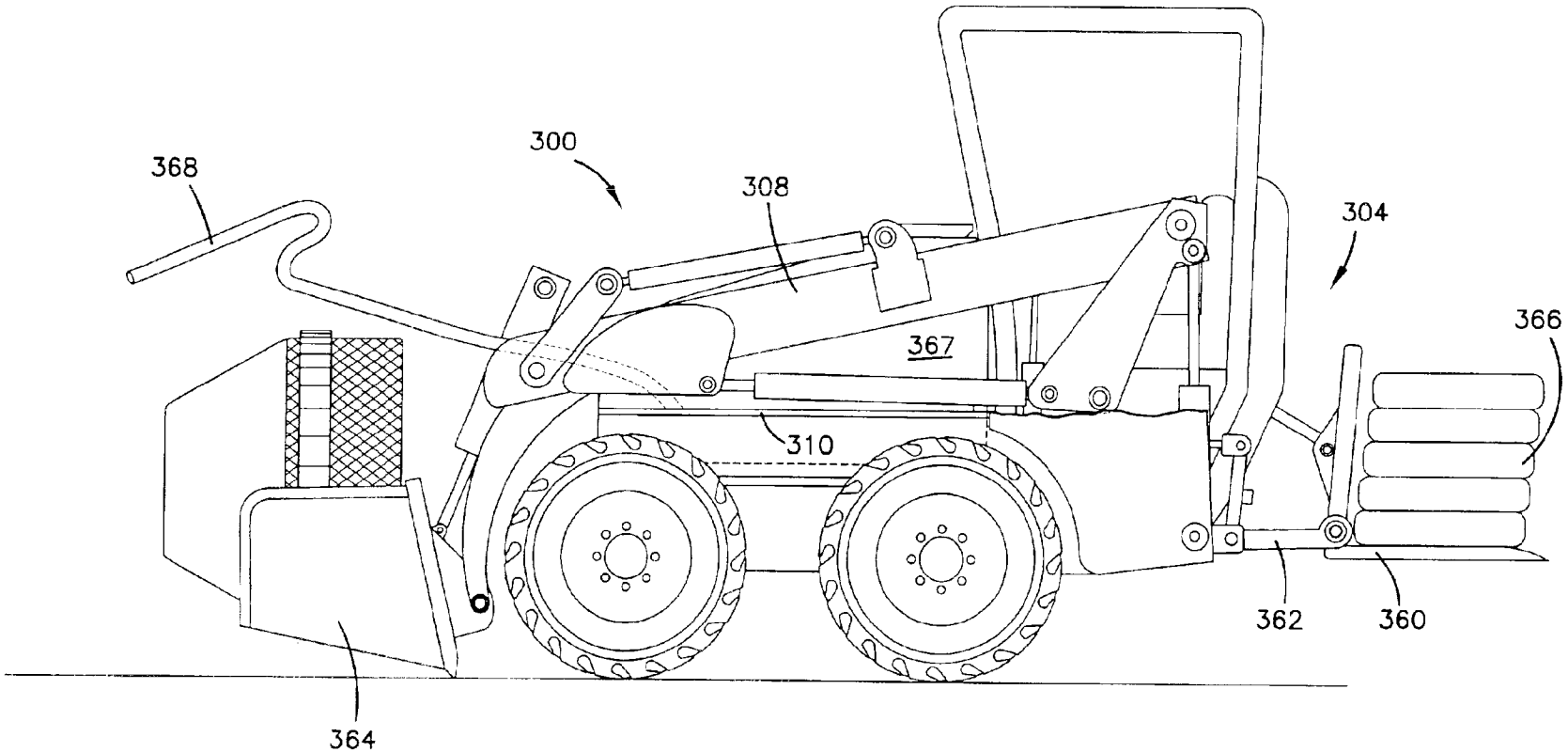
FIG. 11 is a side view of a compact loader according to the principles of the present invention.

FIG. 11 shows a compact loader 300 having a lift 360 attached to the hitch 362 in the rear tools area 304. In addition, a cement mixer 364 can be provided attached to the boom assembly 308. A hose 368 can be provided for supplying water from a liquid tank 367 mounted on the work platform 310. The lift 360 can be used for carrying items such as cement bags 366 while the liquid tank 367 can carry water which can flow through the hose 368 and into the cement mixer 364. This can allow for remote making of cement. The water can be distributed through a pump or gravity fed by the lifting of the work platform 310. It should be noted that the liquid tank 367 can also be placed in a dump box rather than on the work platform 310.

Figure 12:
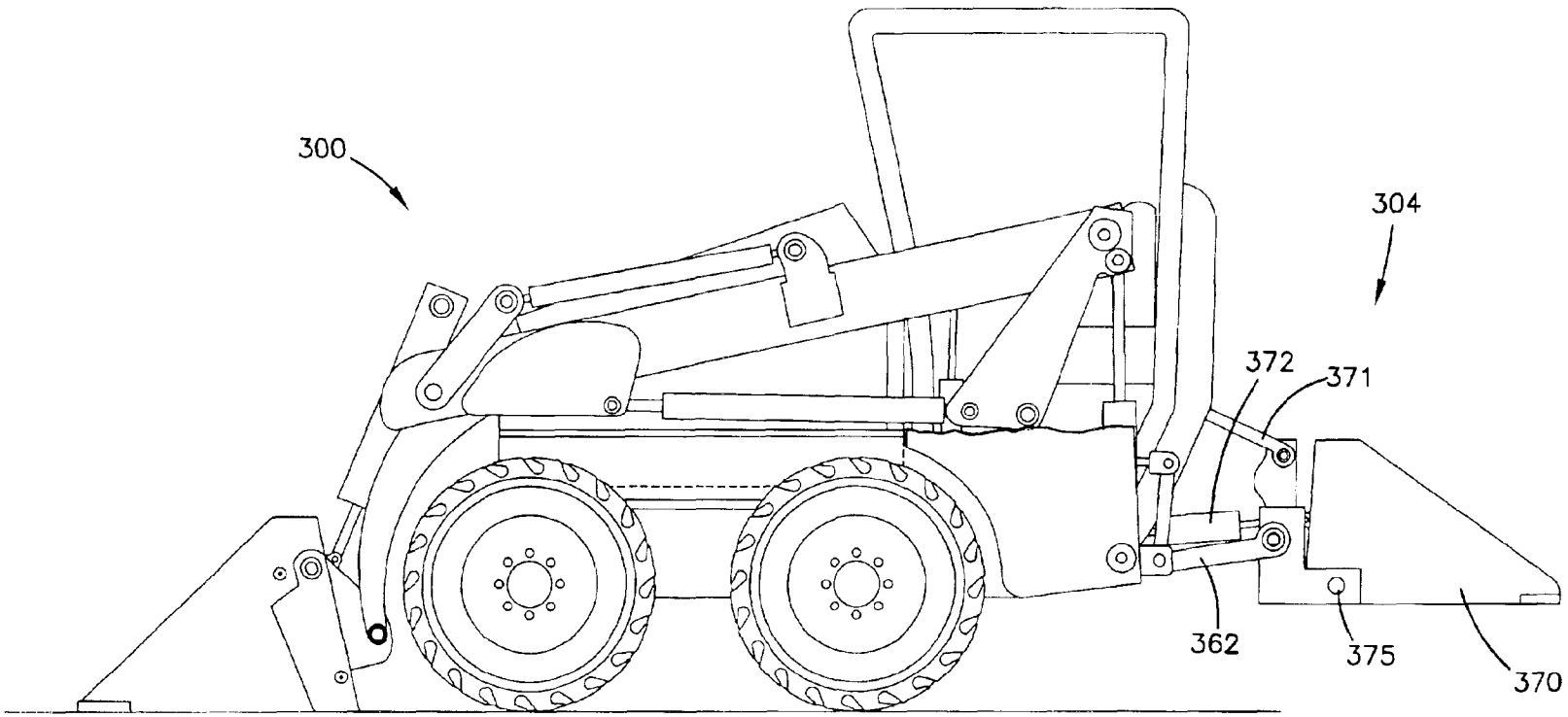
FIG. 12 is a side view of a compact loader according to the principles of the present invention.

FIG. 12 shows a compact loader 300 having a secondary bucket 370 attached to the hitch 362 in the rear tools area 304. The secondary bucket 370 can be used for increased hauling capacity and/or as a general purpose bucket if an attachment other than a bucket is mounted on the loader. The secondary bucket 370 may be attached to a three point hitch 371. The secondary bucket 370 can also be attached to a rear mounted hydraulic cylinder 372 for loading and dumping. In general, movement of the cylinder 372 causes the bucket 370 to rotate about the rotation connection 375 relative to the bucket/hitch connection 376.

Figure 13:
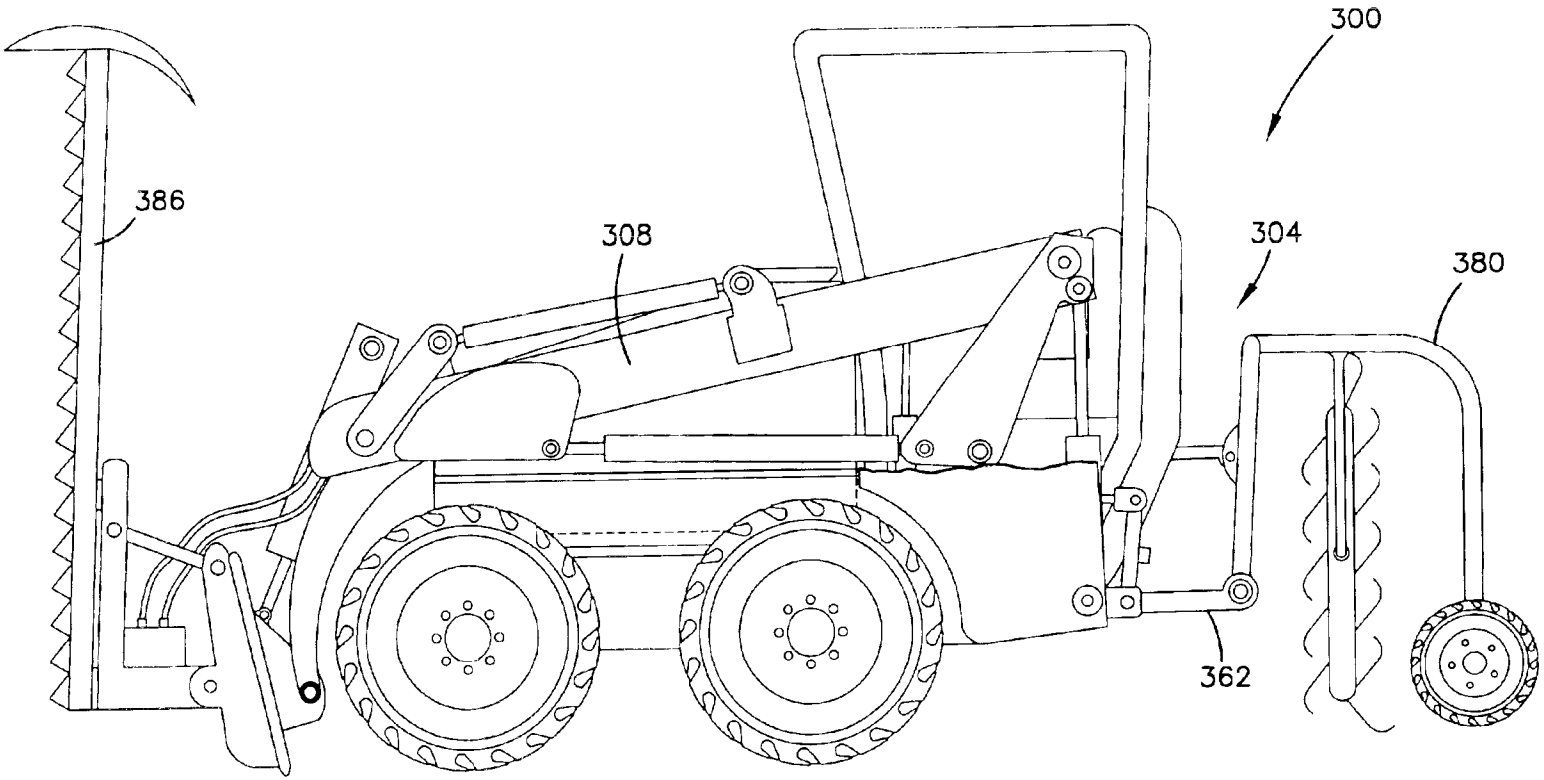
FIG. 13 is a side view of a compact loader according to the principles of the present invention.

FIG. 13 shows a compact loader 300 having a rake 380 attached to the hitch 362 in the rear tools area 304. In addition, a mower 386 can be attached to the boom assembly 308. The mower 386 is shown in a transport position and can be a hydraulic driven mower.

Figure 14:
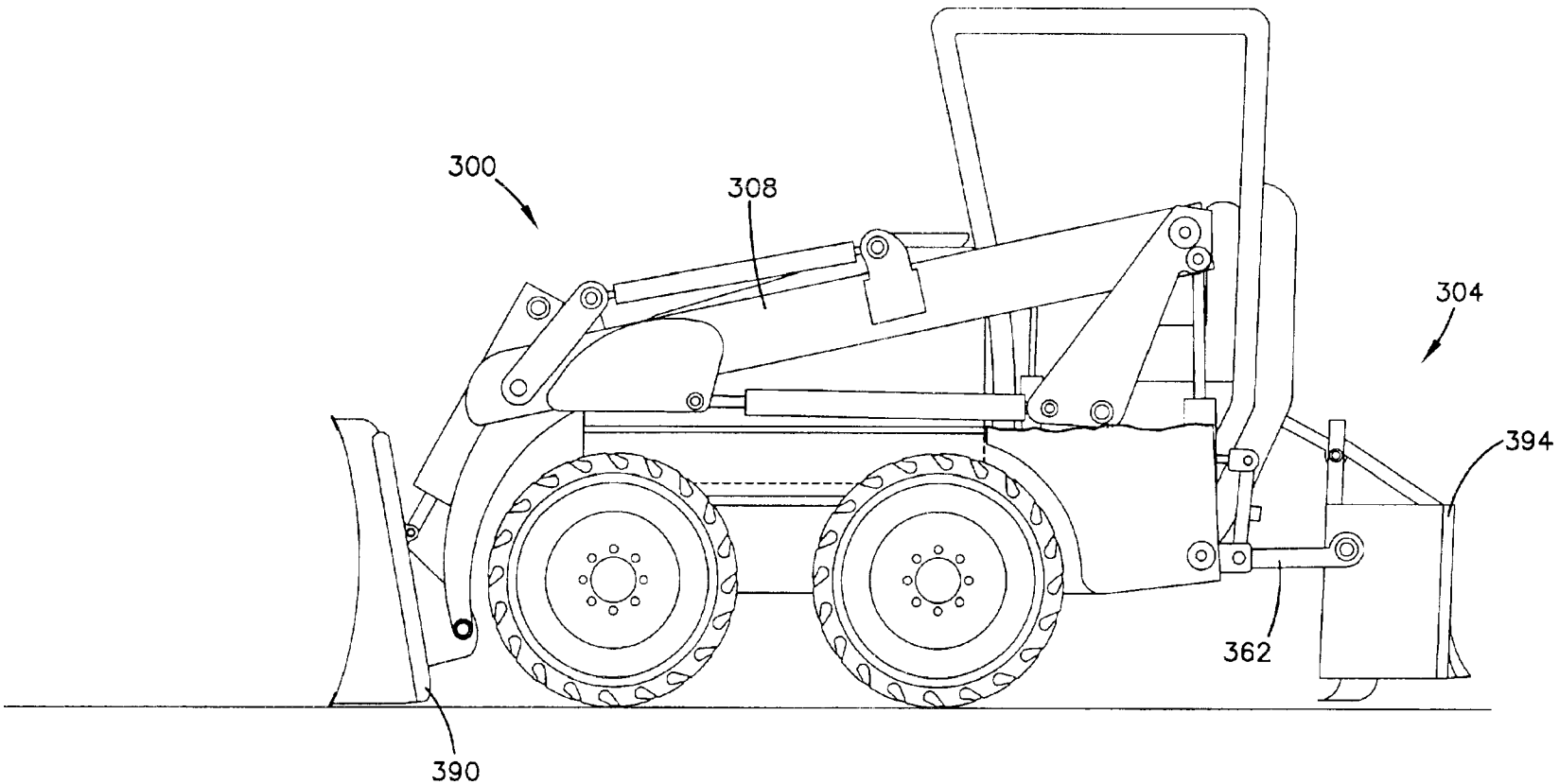
FIG. 14 is a side view of a compact loader according to the principles of the present invention.

FIG. 14 shows a compact loader 300 having a blade 390 attached to the boom assembly 308, and a box scraper 394 attached to the hitch 362 in the rear tools area 304.

Figure 15:
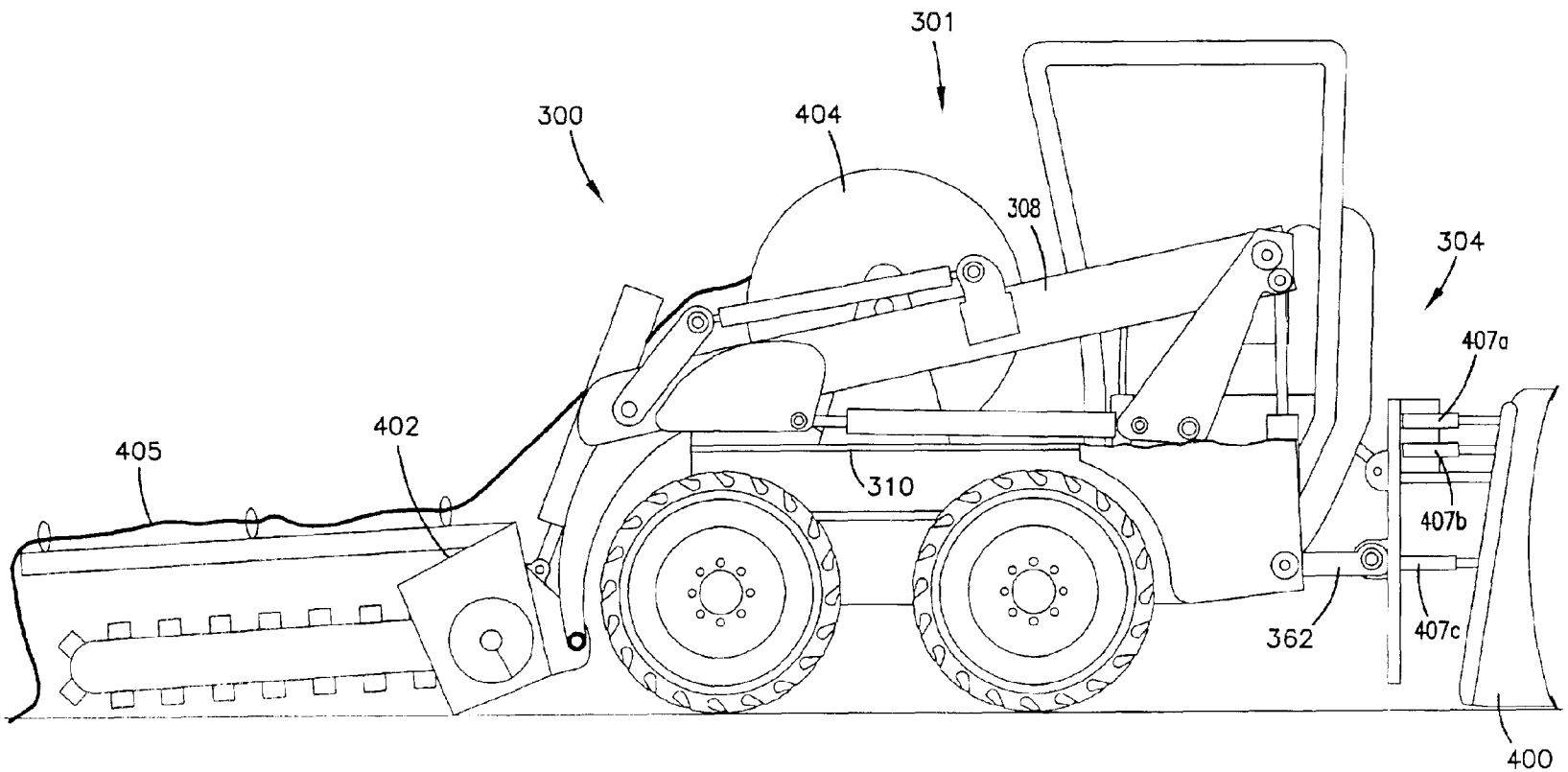
FIG. 15 is a side view of a compact loader according to the principles of the present invention.

FIG. 15 shows a compact loader 300 having an adjustable dozer blade 400 attached to the hitch 362 provided in the rear tools area 304. Hydraulic cylinders 407 (*a*), (*b*) and (*c*) can be used to adjust the dozer blade 400. In addition, a trencher 402 is shown attached to the boom assembly 308, and a cable/wire/hose spool 404 is provided on the work platform 310. Cable/wire/hose 405 can be laid in a trench during the trenching operation.

Figure 16:
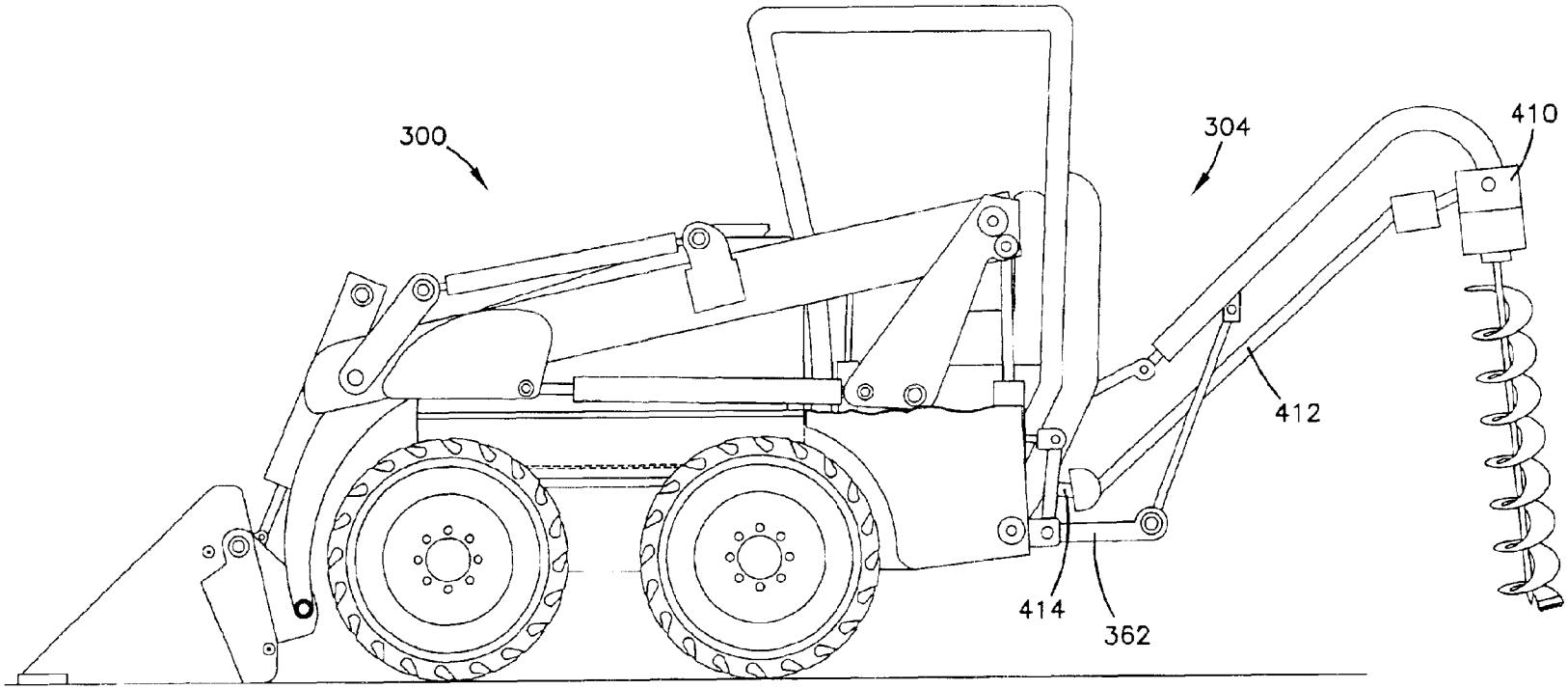
FIG. 16 is a side view of a compact loader according to the principles of the present invention.

FIG. 16 shows a compact loader 300 having a drill 410 attached to the hitch 362 provided in the rear tools area 304. The drill 410 is shown powered by the power take off (PTO) shaft 412 that is coupled to the PTO 414.

Figure 17:
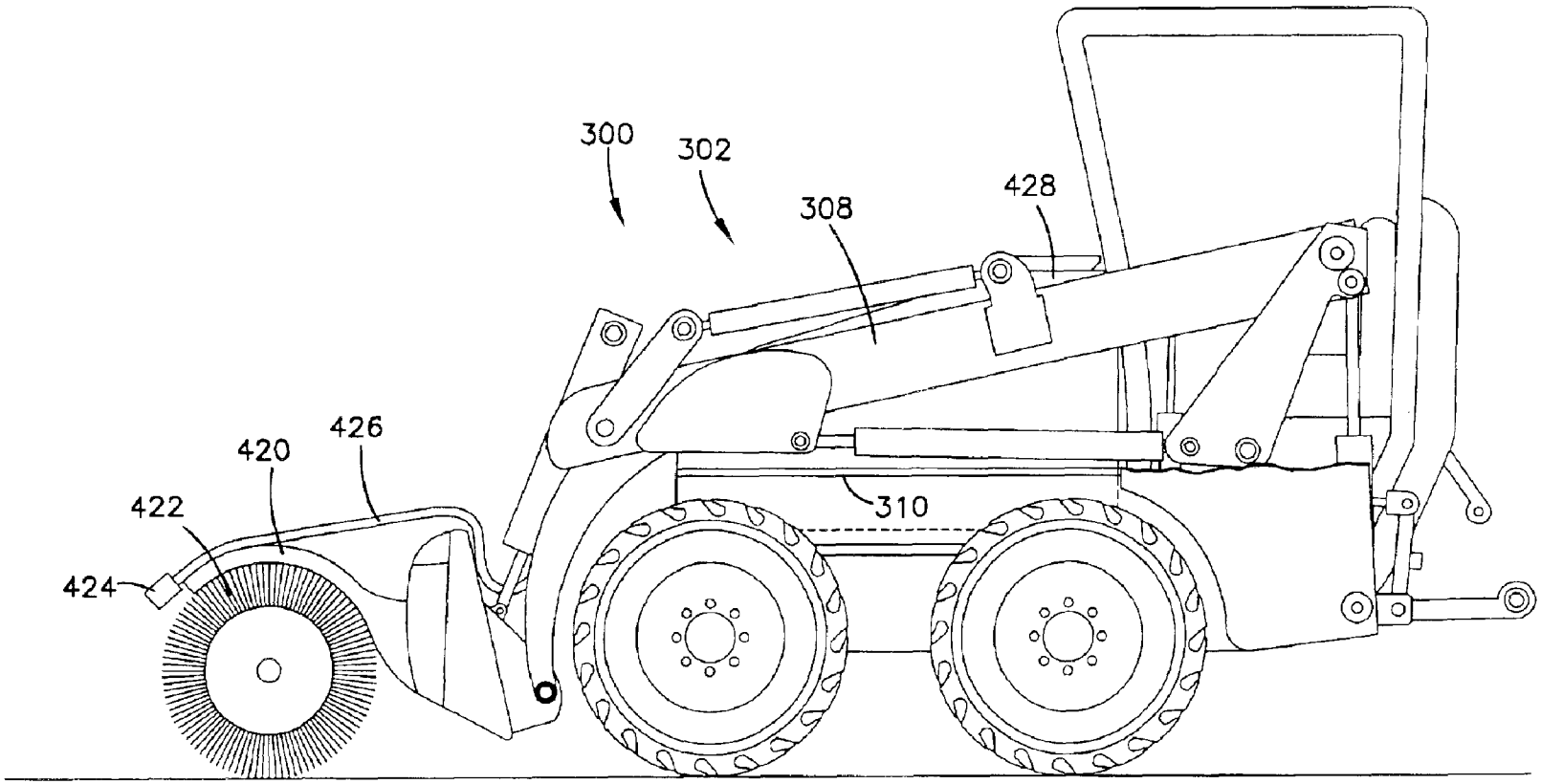
FIG. 17 is a side view of a compact loader according to the principles of the present invention.

FIG. 17 shows a compact loader 300 having a sweeper 420 attached to the boom assembly 308. The sweeper 420 includes a rotating brush 422, a sprayer 424, a delivery hose 426, and a fluid tank 428 provided on the tools platform 310. Commonly available fluid tanks are available for wetting sweeper dust although they are relatively small and are generally hung on the sides of a sweeper machine. It is believed that the fluid tank 428 provided on the work platform 310 is less prone to damage and can hold a much greater capacity of fluid compared with commonly available fluid tanks for wetting sweeper dust. In addition, it should be understood that the fluid tank 428 can be provided in a dump box, if desired.

Figure 18:
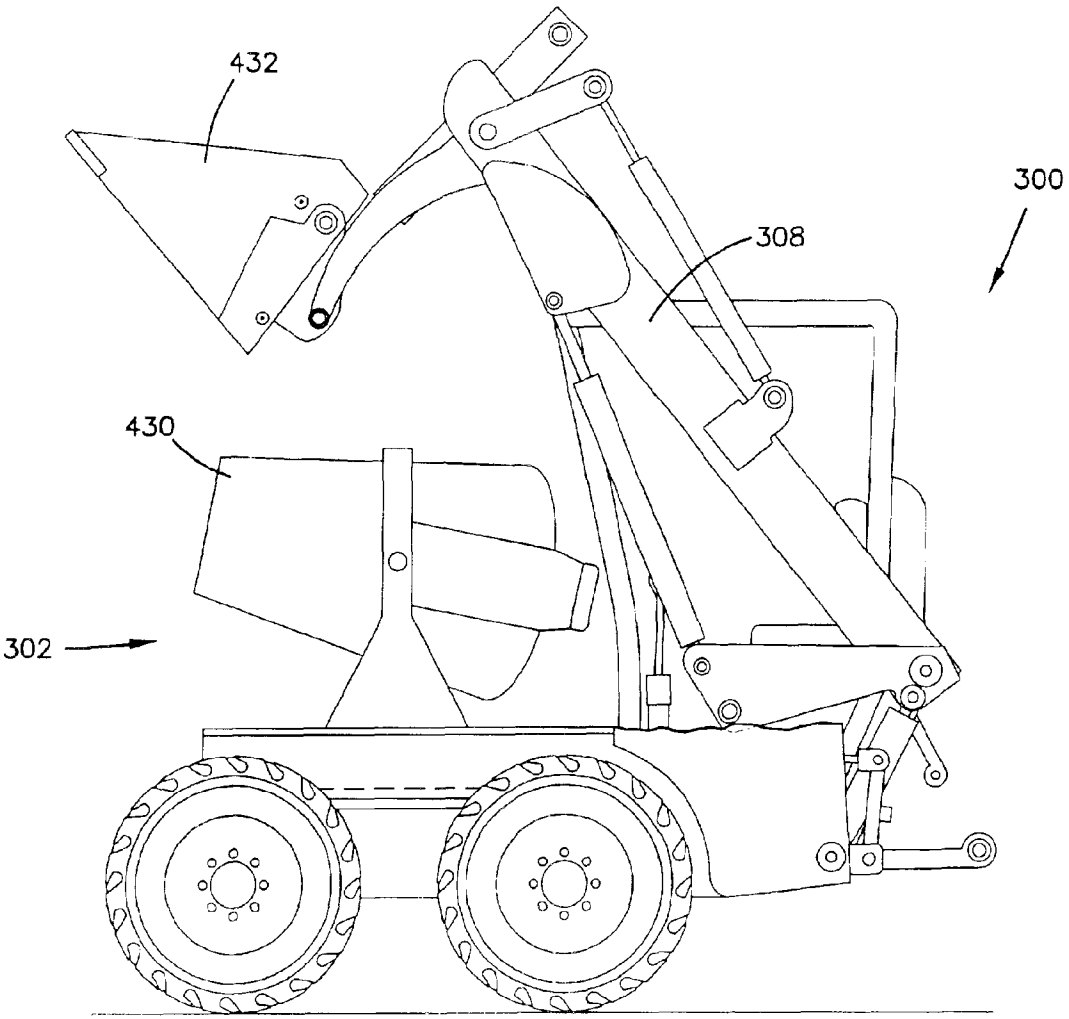
FIG. 18 is a side view of a compact loader according to the principles of the present invention.

FIG. 18 shows a compact loader 300 having a cement mixer 430 provided on the tools platform 310 in the forward tools area 302. It is pointed out that the cement mixer, or any heavy item, can be lifted onto or off of the work platform 310 by utilizing the boom assembly 308 and by attaching a chain, rope, or cable to the bucket 432 and wrapping that around the object.

Figure 19:
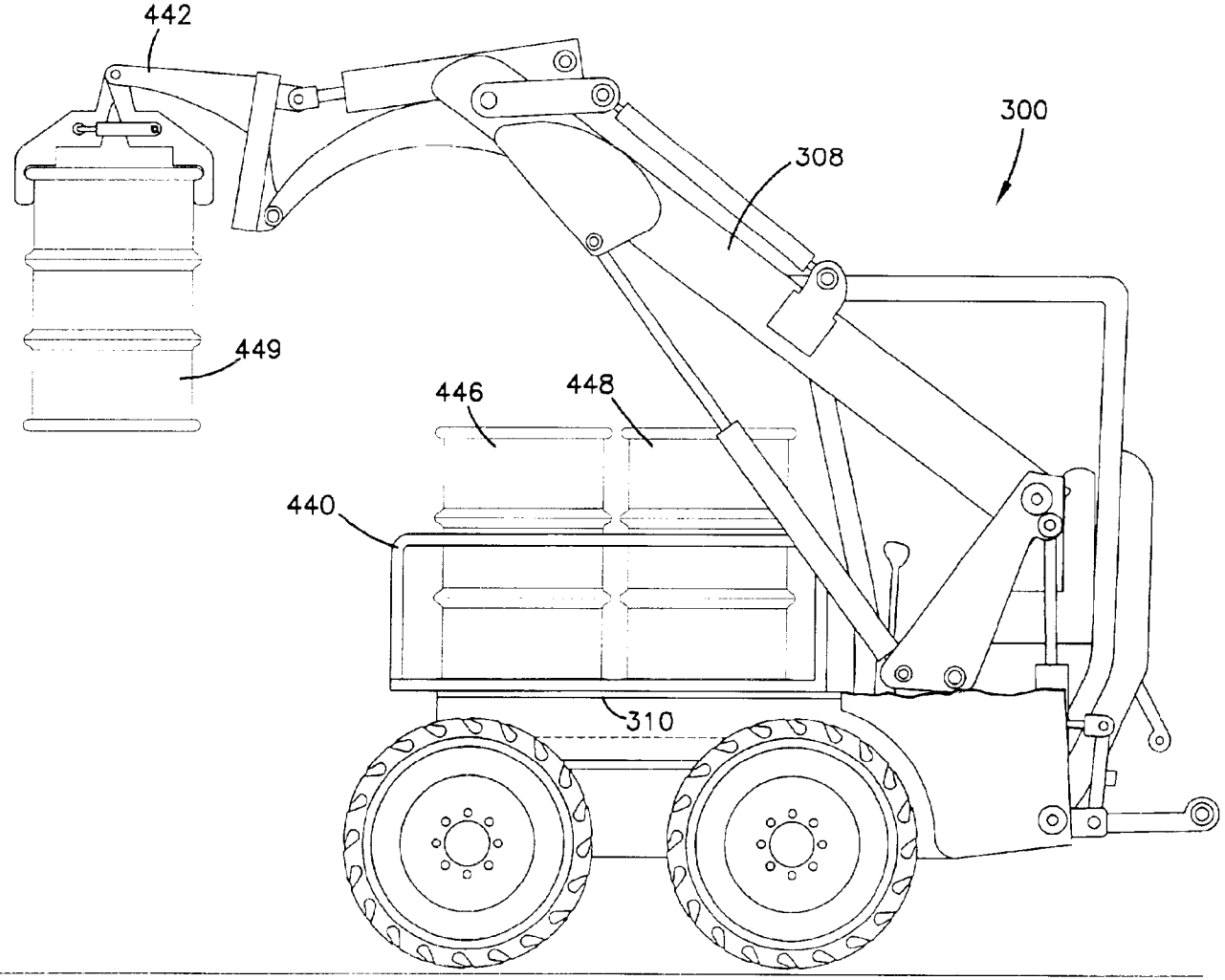
FIG. 19 is a side view of a compact loader according to the principles of the present invention.

FIG. 19 shows a compact loader 300 having a rail assembly 440 provided on the work platform 310, and a container lifter 442 provided on the boom assembly 308. As shown in FIG. 19, drums 446 and 448, such as 55 gallon drums, are shown on the work platform 310, and a drum 449 is shown suspended from the container lifter 442. The container lifter 442 can also be used to load other sized drums including 33 gallon drums.

FIG. 20 shows a compact loader 300 where a portion of the wheel 460 has been cut away to show a hitch 462 attached to the forward end 464 of the compact loader 300. The hitch 462 is shown as a three point hitch 466. The three point hitch 466 can be removed. Accordingly, the compact loader 300 can include a hitch 462 provided on the vehicle forward end 464 and a hitch 468 provided on the rear vehicle end 470. It should be noted that the loader assembly 308 can also be tucked out of the way to rest on the work platform 310 or in a dump box.

FIG. 21 shows a compact loader 300 having a hitch 480 attached to the boom assembly 308. The hitch 480 can be a three point hitch 482. A three point plow 484 is shown attached to the three point hitch 482.

Figure 22:
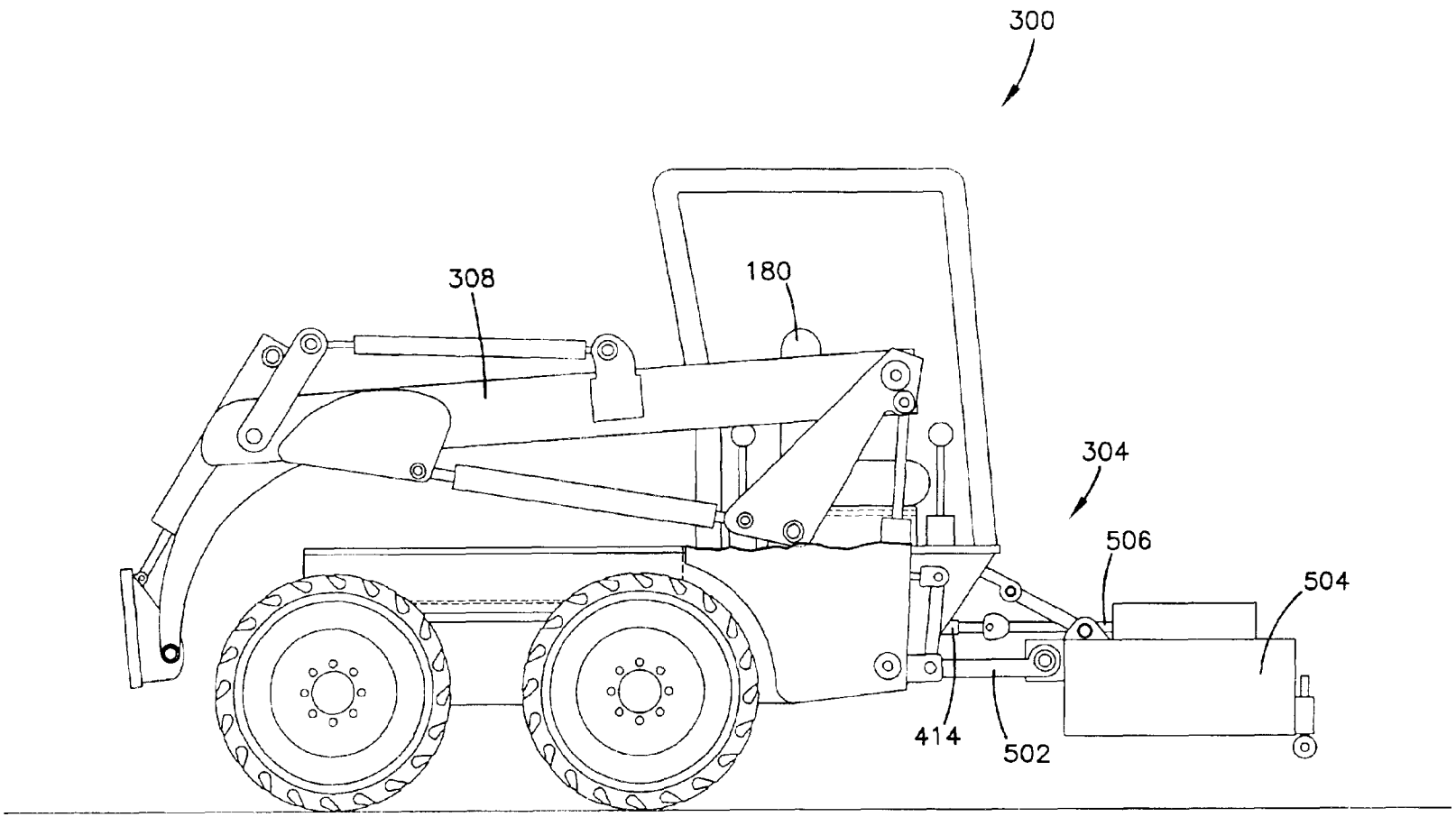
FIG. 22 is a side view of a compact loader according to the principles of the present invention.

FIG. 22 shows a compact loader 300 having a hitch 502 attached in the rear tools area 304 with a mower 504 attached. The mower 504 is shown being driven by a power take off (PTO) shaft 506 that is coupled to the PTO 414. It should be noted that the mower 504 can also be a hydraulic driven mower.

Figure 23:
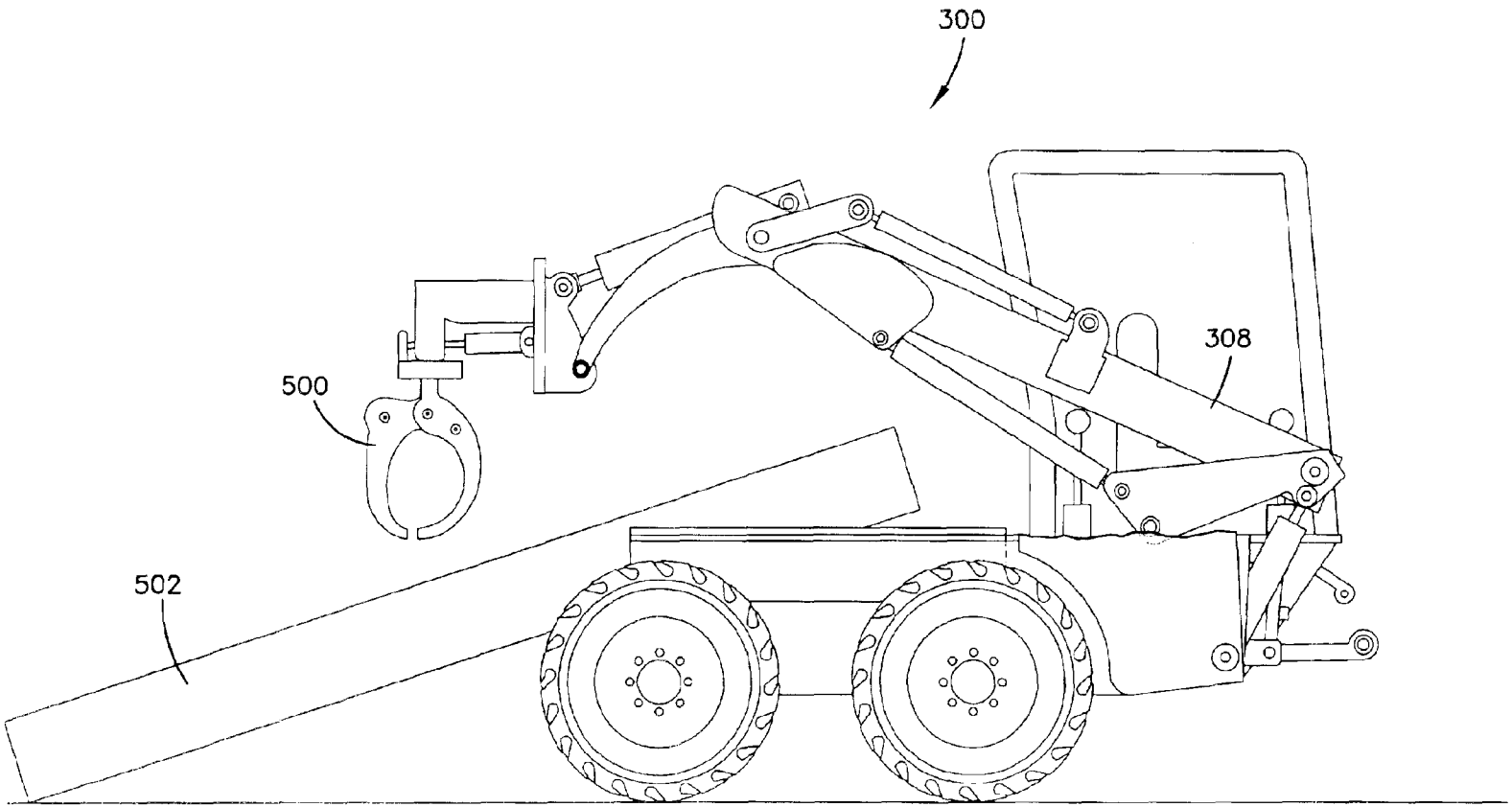
FIG. 23 is a side view of a compact loader according to the principles of the present invention.

FIG. 23 shows a compact loader 300 having a pincer 500 attached to the loader assembly 308 for skidding a long cylindrical object 502 such as a tree, a telephone pole, a pipe, etc.

Figure 24:
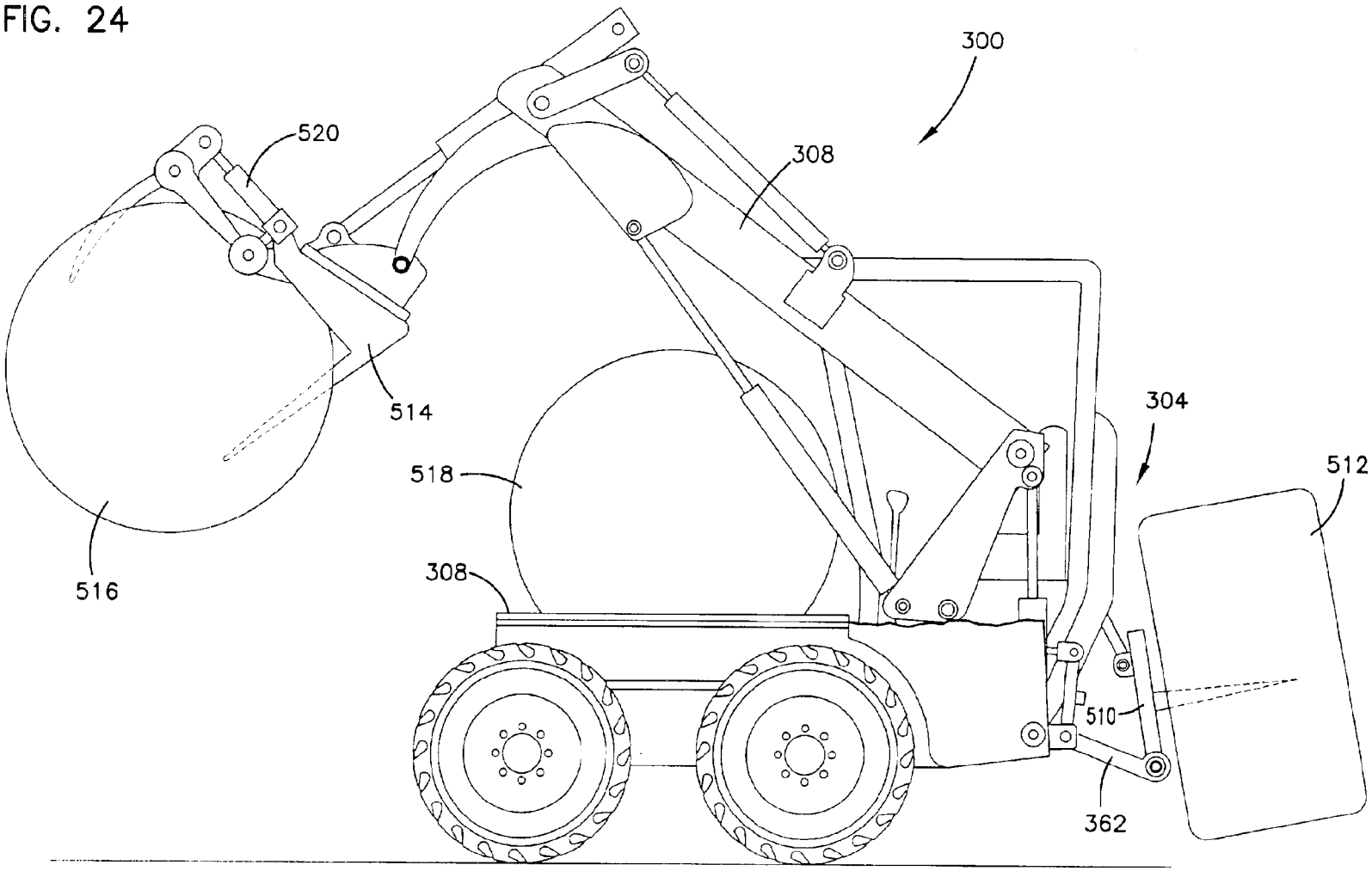
FIG. 24 is a side view of a compact loader according to the principles of the present invention.

FIG. 24 shows a compact loader 300 having a bale spear 510 attached to a hitch 362 provided in the rear tools area 304. The bale spear 510 can be used to spear a bale 512 and move the bale 512 to a new location. In addition, the compact loader 300 can include a bale grappler 514 attached to the boom assembly 308. The bale grappler 514 can be used to move bales 516 and 518. In addition, the bale 518 can be loaded onto the tools platform 308 or onto a dump box. The bale grappler 514 can be operated by a hydraulic cylinder 520.

Figure 26:
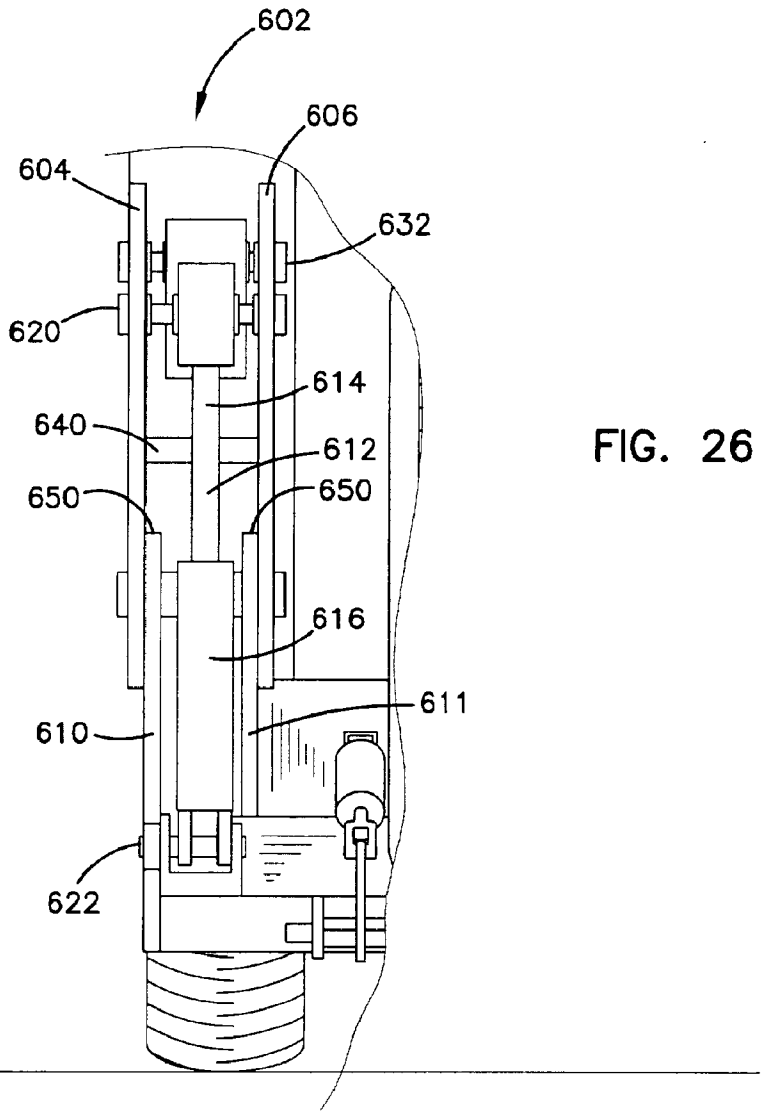
FIG. 26 is a rear view of the tower shown in FIG. 25.
Figure 25:
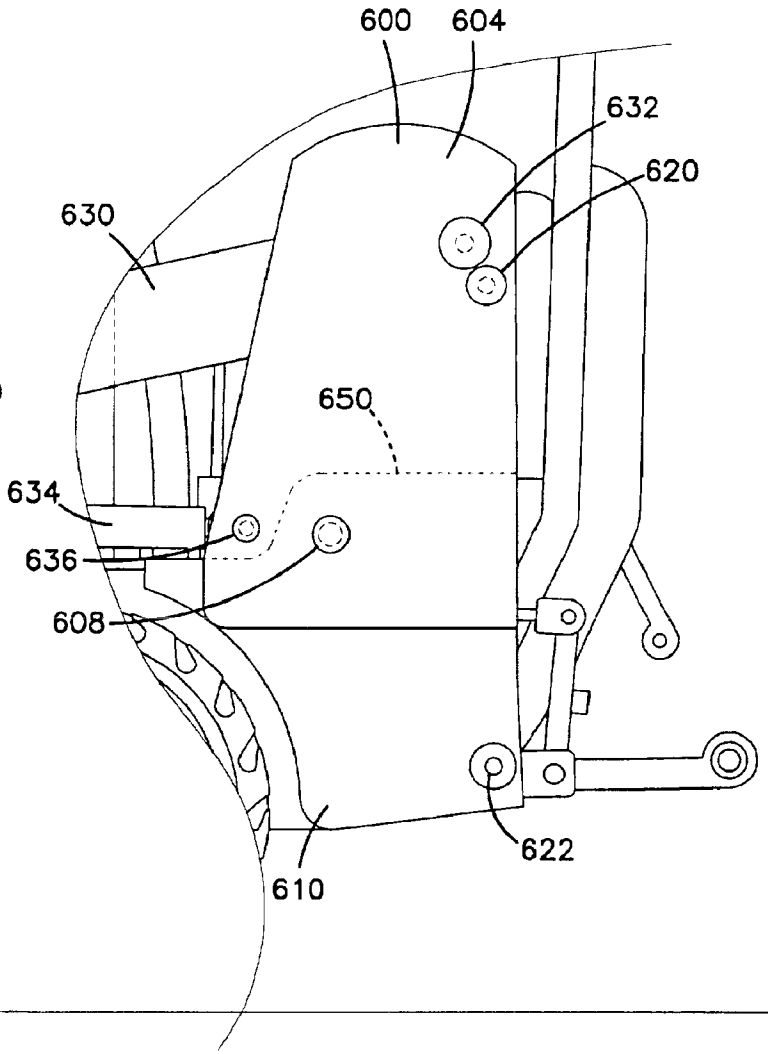
FIG. 25 is a side view of an alternative embodiment of the tower of the compact loader according to the principles of the present invention.

Now referring to FIGS. 25 and 26, an alternative design of the tower assembly of the compact loader according to the invention is shown at reference numeral 600. The tower 600 is provided as part of the left boom 602. The right boom can include a similar tower. The tower 600 includes an outer tower wall 604 and an inner tower wall 606. The tower 600 rotates relative to the chassis about the rotation connection 608. The left support 610 and the right support 611 can be characterized as a part of the chassis. The tower cylinder 612 includes a first tower cylinder end 614 and a second tower cylinder end 616. The first tower cylinder end 614 attaches to the tower 600 at the rotation connection 620, and the second tower cylinder second end 616 attaches to the chassis at the rotation connection 622. The lift arm 630 attaches to the tower 600 at the rotation connection 632. The lift arm cylinder 634 attaches to the tower 600 at the rotation connection 636.

The outer tower wall 604 and the inner tower wall 606 can be attached together by a crossmember 640 and by the various rotation connections 608, 620, 632, and 636 to provide structural support. The left support 610 and the right support 611 are shown extending to an upper edge 650. In general, the limit of the upper edge 650 should be sufficient so that the left support 610 and the right support 611 do not interfere with the rotation of the tower 600. An advantage of the tower 600 is that the tower structure can take the place of the outer cover and the inner cover 70 and 71 of the compact loader 10.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A material handling apparatus comprising:

a vehicle having a front end, a rear end, a left side, a right side, a chassis, and a ground engagement device connected to the chassis for providing movement of the vehicle across ground, wherein the ground engagement device comprises at least one of wheels, tracks, or wheels and tracks;

an engine constructed for propelling the vehicle;

a loader assembly comprising a left boom extending from the vehicle left side, and a right boom extending from the vehicle right side, wherein the left boom and the right boom extend above the ground engagement device and wherein the left boom and the right boom each comprise a lift arm and an attachment arm, the attachment arm comprising:

(a) first attachment arm rotatably connected to the lift arm;

(b) a second attachment arm provided for rotatably connecting to an attachment; and (c) an extension between the first attachment arm and the second attachment arm;

a hydraulic system constructed for driving the loader assembly;

an operator area comprising a cage for protecting an operator located within the operator area, controls for controlling movement of the vehicle and for controlling operation of the loader assembly, and an entrance to the operator area through the rear end of the vehicle; and a forward tools area provided between the operator area and the front end of the vehicle.

2. A material handling apparatus according to claim 1, further comprising an operator seat provided within the operator area.

3. A material handling apparatus according to claim 2, further comprising an entrance to the operator area from the rear end of the vehicle and between at least one of the left boom and the operator seat, and the right boom and the operator seat.

4. A material handling apparatus according to claim 1, further comprising a rear implements area provided at the vehicle rear end for attachment of tools or implements at the vehicle rear end.

5. A material handling apparatus according to the claim 4, wherein the rear implements area can be powered by the hydraulic system and/or by a power takeoff.

6. A material handling apparatus according to claim 5, wherein the rear implements area comprises at least one of a hitch, a lift, a bucket, a rake, a mower, a box scraper, a dozer blade, a drill, and a bale spear.

7. A material handling apparatus according to claim 1, further comprising a dump box provided within the forward tools area, wherein the dump box is constructed to move between a hauling position and a dumping position.

8. A material handling apparatus according to claim 7, wherein the hydraulic system drives the dump box between the hauling position and the dumping position.

9. A material handling apparatus according to claim 1, wherein the forward tools area comprises at least one of a dump box, a work platform, a hitch, a fluid tank, a handheld sprayer, a vacuum/blower device, wire/cable/hose spool, and a cement mixer.

10. A material handling apparatus according to claim 1, further comprising an attachment attached to the loader assembly, wherein the attachment comprises at least one of a bucket, a landscape rake, a spray assembly, a sweeper, a mower, a hitch, a cement mixer, a blade, a trencher, a container lifter, a plow, a pincer, and a bale grappler.

11. A material handling apparatus according to claim 1, wherein the forward tools area comprises a wire/cable/hose spool, and the loader assembly comprises a trencher.

12. A material handling apparatus comprising:

a vehicle having a front end, a rear end, a left side, a right side, a chassis, and a ground engagement device connected to the chassis for providing movement of the vehicle across ground;

an engine constructed for propelling the vehicle;

a loader assembly comprising a left boom extending from the vehicle left side and a right boom extending from the vehicle right side, wherein the left boom and the right boom each comprise:

(i) a tower extending from the vehicle chassis, wherein the tower rotates relative to the vehicle chassis, (ii) a lift arm attached to the tower, wherein the lift arm rotates relative to the tower, and (iii) an attachment arm attached to the lift arm, wherein the attachment arm rotates relative to the lift arm and wherein the attachment arm is constructed to connect to an attachment;

a hydraulic system for driving the loader assembly; and an operator area comprising controls for controlling movement of the vehicle and for controlling operation of the loader assembly.

13. A material handling apparatus according to claim 12, further comprising a forward tools area extending from the operator area to the vehicle front end.

14. A material handling apparatus according to claim 12, further comprising an operator seat provided within the operator area.

15. A material handling apparatus according to claim 14, further comprising an entrance to the operator area from the rear end of the vehicle and between at least one of the left boom and the operator seat, and the right boom and the operator seat.

16. A material handling apparatus according to claim 12, wherein the ground engagement device comprises at least one of wheels, tracks, and wheels and tracks, and wherein the left boom and the right boom extend directly above the ground engagement device.

17. A material handling apparatus according to claim 16, wherein the left boom and the right boom each comprise a lift arm and an attachment arm, the attachment arm comprising:

(i) a first attachment arm rotatably connected to the lift arm;

(ii) a second attachment arm provided for rotatably connecting to an attachment; and (iii) an extension between the first attachment arm and the second attachment arm.

18. A material handling apparatus according to claim 12, further comprising a rear implements area provided at the vehicle rear end for attachment of tools or implements at the vehicle rear end.

19. A material handling apparatus according to claim 18, wherein the rear implements area can be powered by the hydraulic system and/or by a power takeoff.

20. A material handling apparatus according to claim 18, wherein the rear implements area comprises at least one of a hitch, a lift, a bucket, a rake, a mower, a box scraper, a dozer blade, a drill, and a bale spear.

21. A material handling apparatus according to claim 12, further comprising a forward tools area provided between the operator area and the front end of the vehicle.

22. A material handling apparatus according to claim 21, wherein the forward tools area comprises at least one of a dump box, a work platform, a hitch, a fluid tank, a handheld sprayer, a vacuum/blower device, wire/cable/hose spool, and a cement mixer.

23. A material handling apparatus according to claim 12, further comprising an attachment attached to the attachment arm, wherein the attachment comprises at least one of a bucket, a landscape rake, a spray assembly, a sweeper, a mower, a hitch, a cement mixer, a blade, a trencher, a container lifter, a plow, a pincer, and a bale grappler.

24. A material handling apparatus comprising:

a vehicle having a front end, a rear end, a left side, a right side, a chassis, and a ground engagement device attached to the chassis while providing movement of the vehicle across ground;

an engine constructed for propelling the vehicle;

a loader assembly comprising a left boom extending from the vehicle left side, and a right boom extending from the vehicle right side;

a hydraulic system constructed for driving the loader assembly;

an operator area comprising controls for controlling movement of the vehicle and for controlling operation of the loader assembly; and a dump box extending from the operator area to the front end of the vehicle, wherein the dump box is constructed to move between a hauling position and a dumping position;

a transmission cover located below the dump box, wherein the transmission cover is constructed to be moved to access a transmission provided within the vehicle.

25. A material handling apparatus according to claim 24, wherein the hydraulic system is constructed for operating the dump box.

26. A material handling apparatus according to claim 24, wherein the operator area comprises controls for operating the dump box.

27. A material handling apparatus accoridng to claim 24, further comprising a rear implements at the vehicle rear end.

28. A material handling apparatus according to claim 27, wherein the rear implements area can be powered by the hydraulic system or by a power take off.

29. A material handling apparatus according to claim 28, wherein the rear implements area comprises at least one of a hitch, lift, a bucket, a rake, a mower, a box scraper, a dozer blade, a drill, or a bale spear.

* * * * *

UNITED STATES PATENT AND TRADEMARK OFFICE

CERTIFICATE OF CORRECTION

PATENT NO. : 6,997,667 B2
APPLICATION NO. : 10/294464
DATED : February 14, 2006
INVENTOR(S) : Hackett et al.

It is certified that error appears in the above-identified patent and that said Letters Patent is hereby corrected as shown below:

Col. 17, line 11, claim 9: "and a cement mixer." should read --or a cement mixer.--

Col. 18, line 11, claim 20: "and a bale spear." should read --or a bale spear.--

Col. 18, line 20, claim 22: "and a cement mixer." should read --or a cement mixer.--

Col. 18, lines 57-58, claim 27: "A material handling apparatus accoridng to claim 24, further comprising a rear implements at the vehicle rear end." should read --A material handling apparatus according to claim 24, further comprising a rear implements area provided at the vehicle rear end for attachment of tools or implements at the vehicle rear end.--

Signed and Sealed this

Eleventh Day of July, 2006

JON W. DUDAS
*Director of the United States Patent and Trademark Office*